US010316633B2

(12) United States Patent
Savari et al.

(10) Patent No.: US 10,316,633 B2
(45) **Date of Patent: *Jun. 11, 2019**

(54) METHODS FOR TREATMENT OF A SUBTERRANEAN FORMATION

(71) Applicant: Halliburton Energy Services, Inc., Houston, TX (US)

(72) Inventors: Sharath Savari, Stafford, TX (US); Yogesh Kumar Choudhary, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 51 days.

This patent is subject to a terminal disclaimer.

(21) Appl. No.: 15/788,268

(22) Filed: Oct. 19, 2017

(65) Prior Publication Data

US 2018/0038212 A1 Feb. 8, 2018

Related U.S. Application Data

(60) Division of application No. 14/061,575, filed on Oct. 23, 2013, now Pat. No. 9,822,625, which is a continuation-in-part of application No. 13/799,421, filed on Mar. 13, 2013, now abandoned.

(51) Int. Cl.

| | |
|---|---|
| ***E21B 43/25*** | (2006.01) |
| ***E21B 21/12*** | (2006.01) |
| ***E21B 21/00*** | (2006.01) |

(52) U.S. Cl.

CPC ..... *E21B 43/25* (2013.01); *E21B 21/003* (2013.01)

(58) Field of Classification Search

None

See application file for complete search history.

(56) References Cited

U.S. PATENT DOCUMENTS

| | | | |
|---|---|---|---|
| 1,999,146 | A | 4/1935 | Ambrose et al. |
| 2,059,459 | A | 11/1936 | Hund et al. |
| 3,157,232 | A | 11/1964 | Joseph et al. |
| 3,730,273 | A | 5/1973 | Wilson |
| 4,007,789 | A | 2/1977 | Clampitt |
| 4,169,797 | A | 10/1979 | Johnston et al. |
| 4,285,401 | A | 8/1981 | Erickson |

(Continued)

FOREIGN PATENT DOCUMENTS

| | | |
|---|---|---|
| WO | 2014159097 | 10/2014 |
| WO | 2015061342 | 4/2015 |

OTHER PUBLICATIONS

Notice of Allowance for U.S. Appl. No. 14/061,575 dated Aug. 8, 2017.

Canadian Office Action for Canadian Application No. 2,899,945 dated Aug. 25, 2016.

Non-Final Office Action for U.S. Appl. No. 13/799,421 dated Jul. 15, 2016.

(Continued)

*Primary Examiner* — Angela M DiTrani Leff

*Assistant Examiner* — Charles R Nold

(74) *Attorney, Agent, or Firm* — Tenley Krueger; C. Tumey Law Group PLLC

(57) ABSTRACT

The present invention relates to methods of treating subterranean formations. In various embodiments, the present invention provides a method of treating a subterranean formation including placing a first aqueous composition and a second aqueous composition in a subterranean formation. The placing includes injecting the first aqueous composition through a tubular passage in a wellbore. The placing also includes injecting the second aqueous composition through an annular passage in the wellbore.

5 Claims, 3 Drawing Sheets

(56) References Cited

U.S. PATENT DOCUMENTS

| | | | |
|---|---|---|---|
| 4,559,790 | A | 12/1985 | Houston |
| 4,612,991 | A | 9/1986 | Shaw |
| 4,842,068 | A | 6/1989 | Vercaemer |
| 6,124,245 | A | 9/2000 | Patel |
| 6,745,815 | B1 | 6/2004 | Senyard et al. |
| 7,350,576 | B2 | 4/2008 | Robertson et al. |
| 7,913,498 | B2 | 3/2011 | Rowatt |
| 2001/0046414 | A1 | 11/2001 | Kinsman et al. |
| 2005/0000731 | A1 | 1/2005 | Nguyen et al. |
| 2005/0194147 | A1 | 9/2005 | Mctcalf et al. |
| 2005/0205261 | A1 | 9/2005 | Andersen et al. |
| 2006/0175059 | A1 | 8/2006 | Sinclair et al. |
| 2008/0000639 | A1 | 1/2008 | Clark et al. |
| 2009/0205821 | A1 | 8/2009 | Smith |
| 2010/0155058 | A1 | 6/2010 | Gordy et al. |
| 2010/0232795 | A1 | 9/2010 | Wang et al. |
| 2010/0288499 | A1 | 11/2010 | Al-dhafeeri et al. |
| 2010/0308257 | A1 | 12/2010 | Lampe et al. |
| 2012/0247758 | A1 | 10/2012 | Smith et al. |
| 2014/0262231 | A1 | 9/2014 | Alam et al. |

OTHER PUBLICATIONS

Final Office Action for U.S. Appl. No. 13/799,421 dated Mar. 10, 2016.

Non-Final Office Action for U.S. Appl. No. 13/799,421 dated Nov. 24, 2015.

Final Office Action for U.S. Appl. No. 13/799,421 dated May 1, 2015.

Non-Final Office Action for U.S. Appl. No. 13/799,421 dated Jan. 16, 2015.

International Search Report and Written Opinion for Application No. PCT/US2014/061609 dated Jan. 28, 2015.

International Search Report and Written Opinion for Application No. PCT/US2014/021943 dated Jun. 25, 2014.

Non-Final Office Action for U.S. Appl. No. 14/061,575 dated Oct. 6, 2016.

Non-Final Office Action for U.S. Appl. No. 14/061,575 dated Feb. 2, 2016.

Final Office Action for U.S. Appl. No. 14/061,575 dated Feb. 8, 2017.

Final Office Action for U.S. Appl. No. 14/061,575 dated Jun. 14, 2016.

METHODS FOR TREATMENT OF A SUBTERRANEAN FORMATION

CROSS-REFERENCE TO RELATED APPLICATIONS

This application is a divisional of and claims the benefit of priority of U.S. application Ser. No. 14/061,575 entitled "METHODS FOR TREATMENT OF A SUBTERRANEAN FORMATION," filed Oct. 23, 2013, which is a continuation-in-part of and claims the benefit of priority under 35 U.S.C. § 120 to U.S. Utility application Ser. No. 13/799,421 entitled "METHODS FOR TREATMENT OF A SUBTERRANEAN FORMATION," filed Mar. 13, 2013, the disclosures of which both are incorporated herein by reference in their entirety.

BACKGROUND OF THE INVENTION

High temperature wells can hinder the ability of treatment fluid components to perform a desired or expected function, which can lead to inefficiencies and increased costs. For example, viscosifiers and lost circulation materials can be less effective or ineffective in certain high temperature downhole environments. An increase in drilling of high temperature wells has led to the identification of new materials that can remain partially or completely effective under high temperatures. However, generally, materials that are robust in high temperature environments are expensive and not environmentally friendly.

SUMMARY OF THE INVENTION

In various embodiments, the present invention provides a method of treating a subterranean formation. The method includes placing a first aqueous composition and a second aqueous composition in a subterranean formation. The placing includes injecting the first aqueous composition through a tubular passage in a wellbore. The placing also includes at least partially simultaneously injecting the second aqueous composition through an annular passage in the wellbore.

In various embodiments, the present invention provides a method of treating a subterranean formation. The method includes placing a first aqueous composition and a second aqueous composition in a subterranean formation. The placing includes injecting the first aqueous composition through a tubular passage in a wellbore. The first aqueous composition includes less than about 30 wt % oil and organic solvents. The first aqueous composition includes at least one of brine, a lost circulation material, a drilling fluid, and a viscosifier. The placing also includes at least partially simultaneously injecting the second aqueous composition through an annular passage in the wellbore. The second aqueous composition includes less than about 30 wt % oil and organic solvents. The second aqueous composition includes at least one of water, brine, brackish water, flowback water, and produced water. The first aqueous composition emerges from the tubular passage downhole and the second aqueous composition emerges from the annular passage downhole, forming a mixture downhole including the first aqueous composition and the second aqueous composition. In various embodiments, the method can also include changing a concentration in the mixture of at least one of the first aqueous composition, the second aqueous composition, a component of the first aqueous composition, and a component of the second aqueous composition by changing at least one of 1) a flow rate of at least one of the first aqueous composition through the tubular passage and the second aqueous composition through the annular passage, and 2) a concentration of at least one of the component of the first aqueous composition and the component of the second aqueous composition.

In various embodiments, the present invention provides a method of treating a subterranean formation. The method includes placing a first aqueous composition and a second aqueous composition in a subterranean formation. The placing can include injecting the first aqueous composition through a tubular passage in a wellbore. The first aqueous composition includes less than about 30 wt % oil and organic solvents. The first aqueous composition includes at least one of brine, a lost circulation material, a drilling fluid, and a viscosifier. The placing includes at least partially simultaneously injecting the second aqueous composition through an annular passage in the wellbore. The second aqueous composition includes less than about 30 wt % oil and organic solvents. The second aqueous composition includes at least one of water, brine, brackish water, flowback water, and produced water. The injection of at least one of the first aqueous composition and the second aqueous composition lowers or maintains below an ambient downhole temperature (e.g., a bottomhole static temperature) a temperature of a downhole region or a material downhole. The downhole region or the material downhole can be at least part of at least one of the mixture, a downhole assembly, a downhole location, a drill string region, and a jointed tubing string region.

In various embodiments, the present invention provides an apparatus. The apparatus includes a pump configured to inject a first aqueous composition into a tubular passage in a wellbore. The apparatus also includes a pump configured to inject a second aqueous composition into an annular passage in the wellbore. The tubular passage and the annular passage are configured to at least one of: 1) allow the second aqueous composition to at least one of cool and maintain the temperature of at least part of at least one of a mixture of the first and second aqueous composition downhole, a downhole assembly, a downhole location, a drill string region, and a jointed tubing string region, and 2) form a mixture of the first aqueous composition and the second aqueous composition downhole.

In various embodiments, the present invention provides a system. The system includes a tubular passage in a wellbore. The tubular passage includes an injected first aqueous composition therein. The system also includes an annular passage in the wellbore. The annular passage includes an injected second aqueous composition therein. The tubular passage and the annular passage are configured to at least one of 1) allow the second aqueous composition to at least one of cool and maintain the temperature of at least part of at least one of a mixture of the first and second aqueous composition downhole, a downhole assembly, a downhole location, a drill string region, and a jointed tubing string region, and 2) form a mixture of the first aqueous composition and the second aqueous composition downhole.

In various embodiments, the present invention provides certain advantages over other methods, apparatus, and systems for treating a subterranean formation, at least some of which are unexpected. For example, in some embodiments, the present invention enables temperature-sensitive materials such as lost circulation materials and viscosifiers to work more effectively in high temperature wells by providing reduced wellbore temperatures, thereby allowing the materials to perform expected functions without having to use substantially increased amounts of the materials and without substantially increasing costs. In some embodiments, the method can avoid the need for specialty materials designed to withstand high temperatures, thereby avoiding the costs and environmental impact associated with these materials.

In various embodiments, by injecting a second aqueous composition through an annular passage, the method can provide superior cooling of downhole areas as compared to other methods including injection of material only through a single passage, such as cooling that is at least one of more effective, more rapid, more cost-effective, more efficient, and lasting for a longer duration. In some embodiments, the injection of aqueous compositions through each of a tubular passage and an annular passage can be superior to techniques including injection of a single fluid through one passage, for example, due to continuous cooling from the second aqueous composition. In various embodiments, the continuous cooling from the second aqueous composition can provide superior cooling as compared to techniques including injection of a single cooling fluid with optional recirculation prior to injection of a temperature-sensitive treatment fluid that can experience rapid downhole temperature rise after cooling fluid injection stops.

In some embodiments, the injection of more than one fluid in adjacent passages can allow one fluid to cool the other fluid during transport downhole; e.g., the heat capacity of the second fluid can help to maintain a lower temperature of the first fluid during transport. In some embodiments, the injection of the second aqueous composition can cool the exterior of the tubular passage and the material therein as the first material is injected through the tubular passage, providing cooling of not only regions downhole but of the first aqueous composition during transport. In some embodiments, the injection of the second aqueous composition in the annular passage can allow continuous cooling of downhole areas during injection of the first aqueous composition, such as cooling of tubing (e.g., tubing subject to hotter temperature such as tubing near a lower region of the wellbore), cooling of subterranean areas, and cooling of bottomhole assembles and other downhole equipment; such continuous cooling ancillary to any heat absorption by the first aqueous composition is not possible in methods not including injection of a second fluid. The method can lower a temperature downhole or maintain a temperature downhole below the ambient downhole temperature, such as in high temperature wells, more effectively than other methods of treating a subterranean formation. For example, in some embodiments, the method can lower a temperature downhole or maintain a lower temperature downhole of at least part of the at least one of injected treatment fluids, a downhole assembly, a drill string region, and a jointed tubing string, more effectively than other methods. The lowering of temperature and maintaining of lower temperatures downhole made possible by various embodiments can enable more effective use of temperature-sensitive materials downhole for longer durations than possible with other techniques. In some embodiments, the temperature downhole can be controlled and adjusted over time by varying the injection rate or temperature of one or more of the first and second aqueous compositions. In some embodiments, variation of the injection rates can provide faster temperature control downhole than other techniques.

In some embodiments, the downhole concentration of the first aqueous composition, the second aqueous composition, or of one or more components of the first aqueous composition and the second aqueous composition, can be controlled by varying the injection rate of the first or second aqueous composition. In some embodiments, the concentration downhole of the first aqueous composition, the second aqueous composition, or of one or more components of the first aqueous composition and the second aqueous composition can be controlled more rapidly than other techniques.

In some embodiments, the present invention allows the dilution of an aqueous composition downhole. In various embodiments, diluting a material downhole can avoid surface mixing equipment and transportation and storage of diluted materials. For example, by diluting brine downhole, embodiments of the present invention can avoid the need to store a larger volume of diluted brine above the surface, such as in an offshore environment or other environment where space is limited. In various embodiments, brine can be managed with less rig space, lower volumes of brine, fewer logistic hurdles, and less pumping time.

BRIEF DESCRIPTION OF THE FIGURES

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

DETAILED DESCRIPTION OF THE INVENTION

Figure 1:
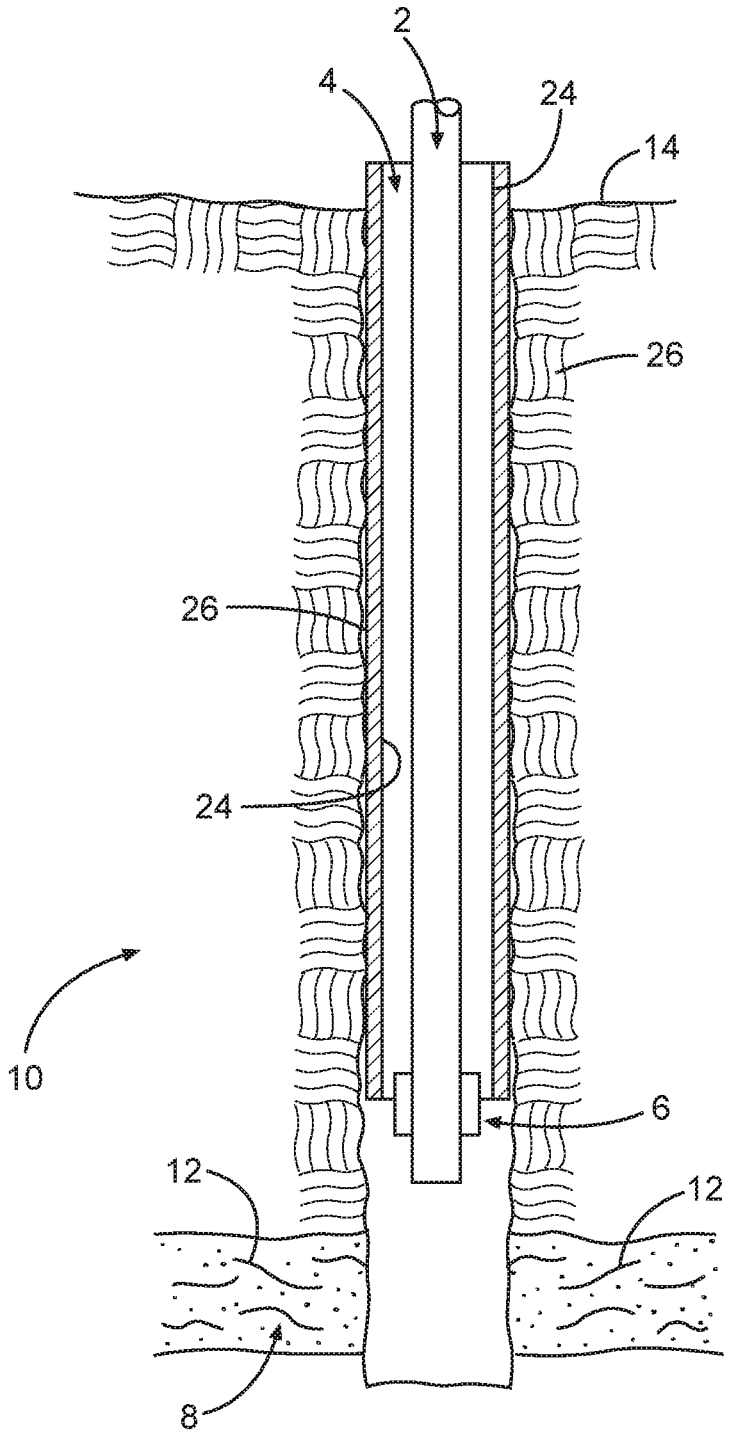
FIG. 1 illustrates a system or apparatus for treating a subterranean formation, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

In the methods of manufacturing described herein, the steps can be carried out in any order without departing from the principles of the invention, except when a temporal or operational sequence is explicitly recited. Furthermore, specified steps can be carried out concurrently unless explicit claim language recites that they be carried out separately. For example, a claimed step of doing X and a claimed step of doing Y can be conducted simultaneously within a single operation, and the resulting process will fall within the literal scope of the claimed process.

Selected substituents within the compounds described herein are present to a recursive degree. In this context, "recursive substituent" means that a substituent may recite another instance of itself or of another substituent that itself recites the first substituent. Recursive substituents are an intended aspect of the disclosed subject matter. Because of the recursive nature of such substituents, theoretically, a large number may be present in any given claim. One of ordinary skill in the art of organic chemistry understands that the total number of such substituents is reasonably limited by the desired properties of the compound intended. Such properties include, by way of example and not limitation, physical properties such as molecular weight, solubility, and practical properties such as ease of synthesis. Recursive substituents can call back on themselves any suitable number of times, such as about 1 time, about 2 times, 3, 4, 5, 6, 7, 8, 9, 10, 15, 20, 30, 50, 100, 200, 300, 400, 500, 750, 1000, 1500, 2000, 3000, 4000, 5000, 10,000, 15,000, 20,000, 30,000, 50,000, 100,000, 200,000, 500,000, 750, 000, or about 1,000,000 times or more.

The term "about" as used herein can allow for a degree of variability in a value or range, for example, within 10%, within 5%, or within 1% of a stated value or of a stated limit of a range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more.

The term "organic group" as used herein refers to but is not limited to any carbon-containing functional group. For example, an oxygen-containing group such as an alkoxy group, aryloxy group, aralkyloxy group, oxo(carbonyl) group, a carboxyl group including a carboxylic acid, carboxylate, and a carboxylate ester; a sulfur-containing group such as an alkyl and aryl sulfide group; and other heteroatom-containing groups. Non-limiting examples of organic groups include OR, OOR, $OC(O)N(R)_2$, CN, $CF_3$, $OCF_3$, R, C(O), methylenedioxy, ethylenedioxy, $N(R)_2$, SR, SOR, $SO_2R$, $SO_2N(R)_2$, $SO_3R$, C(O)R, C(O)C(O)R, $C(O)CH_2C(O)R$, C(S)R, C(O)OR, OC(O)R, $C(O)N(R)_2$, $OC(O)N(R)_2$, $C(S)N(R)_2$, $(CH_2)_{0-2}N(R)C(O)R$, $(CH_2)_{0-2}N(R)N(R)_2$, N(R)N(R)C(O)R, N(R)N(R)C(O)OR, $N(R)N(R)CON(R)_2$, N(R)$SO_2R$, $N(R)SO_2N(R)_2$, N(R)C(O)OR, N(R)C(O)R, N(R)C(S)R, $N(R)C(O)N(R)_2$, $N(R)C(S)N(R)_2$, N(COR)COR, N(OR)R, $C(=NH)N(R)_2$, C(O)N(OR)R, or C(=NOR)R wherein R can be hydrogen (in examples that include other carbon atoms) or a carbon-based moiety, and wherein the carbon-based moiety can itself be further substituted.

The term "substituted" as used herein refers to an organic group as defined herein or molecule in which one or more hydrogen atoms contained therein are replaced by one or more non-hydrogen atoms. The term "functional group" or "substituent" as used herein refers to a group that can be or is substituted onto a molecule or onto an organic group. Examples of substituents or functional groups include, but are not limited to, a halogen (e.g., F, Cl, Br, and I); an oxygen atom in groups such as hydroxyl groups, alkoxy groups, aryloxy groups, aralkyloxy groups, oxo(carbonyl) groups, carboxyl groups including carboxylic acids, carboxylates, and carboxylate esters; a sulfur atom in groups such as thiol groups, alkyl and aryl sulfide groups, sulfoxide groups, sulfone groups, sulfonyl groups, and sulfonamide groups; a nitrogen atom in groups such as amines, hydroxylamines, nitriles, nitro groups, N-oxides, hydrazides, azides, and enamines; and other heteroatoms in various other groups. Non-limiting examples of substituents J that can be bonded to a substituted carbon (or other) atom include F, Cl, Br, I, OR, $OC(O)N(R')_2$, CN, NO, $NO_2$, $ONO_2$, azido, $CF_3$, $OCF_3$, R', O (oxo), S (thiono), C(O), S(O), methylenedioxy, ethylenedioxy, $N(R)_2$, SR, SOR, $SO_2R'$, $SO_2N(R)_2$, $SO_3R$, C(O)R, C(O)C(O)R, $C(O)CH_2C(O)R$, C(S)R, C(O)OR, OC(O)R, $C(O)N(R)_2$, $OC(O)N(R)_2$, $C(S)N(R)_2$, $(CH_2)_{0-2}N(R)C(O)R$, $(CH_2)_{0-2}N(R)N(R)_2$, N(R)N(R)C(O)R, N(R)N(R)C(O)OR, $N(R)N(R)CON(R)_2$, N(R)$SO_2R$, $N(R)SO_2N(R)_2$, N(R)C(O)OR, N(R)C(O)R, N(R)C(S)R, $N(R)C(O)N(R)_2$, $N(R)C(S)N(R)_2$, N(COR)COR, N(OR)R, $C(=NH)N(R)_2$, C(O)N(OR)R, or C(=NOR)R wherein R can be hydrogen or a carbon-based moiety, and wherein the carbon-based moiety can itself be further substituted; for example, wherein R can be hydrogen, alkyl, acyl, cycloalkyl, aryl, aralkyl, heterocyclyl, heteroaryl, or heteroarylalkyl, wherein any alkyl, acyl, cycloalkyl, aryl, aralkyl, heterocyclyl, heteroaryl, or heteroarylalkyl or R can be independently mono- or multi-substituted with J; or wherein two R groups bonded to a nitrogen atom or to adjacent nitrogen atoms can together with the nitrogen atom or atoms form a heterocyclyl, which can be mono- or independently multi-substituted with J.

The term "alkyl" as used herein refers to straight chain and branched alkyl groups and cycloalkyl groups having from 1 to 40 carbon atoms, 1 to about 20 carbon atoms, 1 to 12 carbons or, in some embodiments, from 1 to 8 carbon atoms. Examples of straight chain alkyl groups include those with from 1 to 8 carbon atoms such as methyl, ethyl, n-propyl, n-butyl, n-pentyl, n-hexyl, n-heptyl, and n-octyl groups. Examples of branched alkyl groups include, but are not limited to, isopropyl, iso-butyl, sec-butyl, t-butyl, neopentyl, isopentyl, and 2,2-dimethylpropyl groups. As used herein, the term "alkyl" encompasses n-alkyl, isoalkyl, and anteisoalkyl groups as well as other branched chain forms of alkyl. Representative substituted alkyl groups can be substituted one or more times with any of the groups listed herein, for example, amino, hydroxy, cyano, carboxy, nitro, thio, alkoxy, and halogen groups.

The term "alkenyl" as used herein refers to straight and branched chain and cyclic alkyl groups as defined herein, except that at least one double bond exists between two carbon atoms. Thus, alkenyl groups have from 2 to 40 carbon atoms, or 2 to about 20 carbon atoms, or 2 to 12 carbons or, in some embodiments, from 2 to 8 carbon atoms. Examples include, but are not limited to vinyl, —CH=CH $(CH_3)$, $—CH{=}C(CH_3)_2$, $—C(CH_3){=}CH_2$, $—C(CH_3){=}CH(CH_3)$, $—C(CH_2CH_3){=}CH_2$, cyclohexenyl, cyclopentenyl, cyclohexadienyl, butadienyl, pentadienyl, and hexadienyl among others.

The term "hydrocarbon" as used herein refers to a functional group or molecule that includes carbon and hydrogen atoms. The term can also refer to a functional group or molecule that normally includes both carbon and hydrogen atoms but wherein all the hydrogen atoms are substituted with other functional groups.

As used herein, the term "hydrocarbyl" refers to a functional group derived from a straight chain, branched, or cyclic hydrocarbon, and can be alkyl, alkenyl, alkynyl, aryl, cycloalkyl, acyl, or any combination thereof.

The term "solvent" as used herein refers to a liquid that can dissolve a solid, liquid, or gas. Nonlimiting examples of solvents are silicones, organic compounds, water, alcohols, ionic liquids, and supercritical fluids.

The term "room temperature" as used herein refers to a temperature of about 15° C. to 28° C.

The term "standard temperature and pressure" as used herein refers to 20° C. and 101 kPa.

As used herein, the term "polymer" refers to a molecule having at least one repeating unit and can include copolymers.

The term "copolymer" as used herein refers to a polymer that includes at least two different monomers. A copolymer can include any suitable number of monomers.

The term "downhole" as used herein refers to under the surface of the earth, such as a location within or fluidly connected to a wellbore.

As used herein, the term "drilling fluid" refers to fluids, slurries, or muds used in drilling operations downhole, such as during the formation of the wellbore.

As used herein, the term "stimulation fluid" refers to fluids or slurries used downhole during stimulation activities of the well that can increase the production of a well, including perforation activities. In some examples, a stimulation fluid can include a fracturing fluid, or an acidizing fluid.

As used herein, the term "clean-up fluid" refers to fluids or slurries used downhole during clean-up activities of the well, such as any treatment to remove material obstructing the flow of desired material from the subterranean formation. In one example, a clean-up fluid can be an acidification treatment to remove material formed by one or more perforation treatments. In another example, a clean-up fluid can be used to remove a filter cake.

As used herein, the term "fracturing fluid" refers to fluids or slurries used downhole during fracturing operations.

As used herein, the term "spotting fluid" refers to fluids or slurries used downhole during spotting operations, and can be any fluid designed for localized treatment of a downhole region. In one example, a spotting fluid can include a lost circulation material for treatment of a specific section of the wellbore, such as to seal off fractures in the wellbore and prevent sag. In another example, a spotting fluid can include a water control material. In some examples, a spotting fluid can be designed to free a stuck piece of drilling or extraction equipment, reduce torque and drag with drilling lubricants, prevent differential sticking, promote wellbore stability, and can help to control mud weight.

As used herein, the term "completion fluid" refers to fluids or slurries used downhole during the completion phase of a well, including cementing compositions.

As used herein, the term "remedial treatment fluid" refers to fluids or slurries used downhole for remedial treatment of a well. Remedial treatments can include treatments designed to increase or maintain the production rate of a well, such as stimulation or clean-up treatments.

As used herein, the term "fluid" refers to liquids and gels, unless otherwise indicated.

As used herein, the term "subterranean material" or "subterranean formation" refers to any material under the surface of the earth, including under the surface of the bottom of the ocean. For example, a subterranean formation or material can be any section of a wellbore and any section of a subterranean petroleum- or water-producing formation or region in fluid contact with the wellbore. Placing a material in a subterranean formation can include contacting the material with any section of a wellbore or with any subterranean region in fluid contact therewith. Subterranean materials can include any materials placed into the wellbore such as cement, drill shafts, liners, tubing, or screens; placing a material in a subterranean formation can include contacting with such subterranean materials. In some examples, a subterranean formation or material can be any below-ground region that can produce liquid or gaseous petroleum materials, water, or any section below-ground in fluid contact therewith. For example, a subterranean formation or material can be at least one of an area desired to be fractured, a fracture or an area surrounding a fracture, and a flow pathway or an area surrounding a flow pathway, wherein a fracture or a flow pathway can be optionally fluidly connected to a subterranean petroleum- or water-producing region, directly or through one or more fractures or flow pathways.

As used herein, "treatment of a subterranean formation" can include any activity directed to extraction of water or petroleum materials from a subterranean petroleum- or water-producing formation or region, for example, including drilling, stimulation, hydraulic fracturing, clean-up, acidizing, completion, cementing, remedial treatment, abandonment, and the like.

As used herein, a "flow pathway" downhole can include any suitable subterranean flow pathway through which two subterranean locations are in fluid connection. The flow pathway can be sufficient for petroleum or water to flow from one subterranean location to the wellbore, or vice-versa. A flow pathway can include at least one of a hydraulic fracture, a fluid connection across a screen, across gravel pack, across proppant, including across resin-bonded proppant or proppant deposited in a fracture, and across sand. A flow pathway can include a natural subterranean passageway through which fluids can flow. In some embodiments, a flow pathway can be a water source and can include water. In some embodiments, a flow pathway can be a petroleum source and can include petroleum. In some embodiments, a flow pathway can be sufficient to divert from a wellbore, fracture, or flow pathway connected thereto at least one of water, a downhole fluid, or a produced hydrocarbon.

Method of Treating a Subterranean Formation.

In various embodiments, the present invention provides a method of treating a subterranean formation. The method can include placing a first aqueous composition and a second aqueous composition in a subterranean formation. The placing includes injecting the first aqueous composition through a tubular passage in a wellbore. The placing also includes at least partially simultaneously (e.g., for at least some period of time the injection is simultaneous) injecting the second aqueous composition through an annular passage in the wellbore. The injecting can be any suitable injecting, such that the first and second compositions move downwards through the wellbore. The injecting can occur from the surface or from a location below the surface. The injecting can include pumping. In some embodiments, the injection of the first aqueous composition and the injection of the second aqueous composition are substantially simultaneous. In some embodiments, the first aqueous composition emerges from the tubular passage downhole and the second aqueous composition emerges from the annular passage downhole to form a mixture downhole including the first aqueous composition and the second aqueous composition. In some embodiments, as compared to a corresponding method without the second aqueous composition, the second aqueous composition can at least one of cool and maintain a temperature of at least part of at least one of a mixture of the first and second aqueous composition downhole, a downhole assembly, a downhole location, a drill string region, and a jointed tubing string region.

The tubular passage can be any suitable tubular passage in the wellbore. For example, the tubular passage can be a drill string, a jointed tubing string, a coiled tubing, or a combination thereof. The annular passage can be any suitable annular passage in the wellbore, such that the second aqueous composition can provide cooling as described herein or such that the second aqueous composition can mix with the first aqueous composition downhole. The annular passage can be between the wall of a wellbore or casing on the wall of a wellbore and the outside of the tubular passage. In some embodiments, the annulus can be interposed between two conduits rather than between a conduit and the wall or casing of the wellbore. The annular passage can include any suitable space between the wellbore and the tubular passage. For example, the annular passage can include at least one of a space between a drill string and a wellbore, a space between a drill string and a casing, a space between a coiled tubing and a wellbore, a space between a coiled tubing and a casing, a space between a coiled tubing and jointed tubing string, a space between a jointed tubing string and a casing, and a space between a jointed tubing string and a wellbore. For example, the tubular passage can include a drill string and the annular passage can include a space at least one between the drill string and a wellbore and between the drill string and casing. In some embodiments, the tubular passage includes coiled tubing and the annular passage includes at least one of a space between the coiled tubing and a casing, a space between the coiled tubing and a wellbore, a space between a drill string and a casing, a space between the coiled tubing and a jointed tubing string, a space between a jointed tubing string and a wellbore, a space between a jointed tubing string and a casing, and a space between a drill string and a wellbore. In some embodiments, the tubular passage includes a jointed tubing string and the annular passage includes at least one of a space between the jointed tubing string and a casing, and a space between the jointed tubing string and a wellbore.

First and Second Aqueous Compositions.

Embodiments of the method can include injecting a first aqueous composition in a tubular passage in a wellbore, and at least partially simultaneously injecting the second aqueous composition in an annular passage in the wellbore. The first and second aqueous composition can be any suitable aqueous compositions, such that the method can be carried out as described herein. In some embodiments, the first and second aqueous composition have substantially the same composition. In some embodiments, the first and second aqueous composition have different compositions. Each of the first aqueous composition and the second aqueous composition can independently include about 30 wt % to about 100 wt % water, or greater than about 70 wt % water, or 30 wt % or less water, or 35 wt % water, 40 wt %, 45, 50, 55, 60, 65, 70, 75, 80, 85, 90, 95, 96, 97, 98, 99, 99.9, or about 99.99 wt % water or more. Each of the first aqueous composition and the second aqueous composition can independently have less than about 30 wt % oil and organic solvents (e.g., less than 30 wt % of oil and organic solvents combined), such as about 25 wt % oils and organic solvents or about 20 wt %, 15, 10, 5, 4, 3, 2, 1, 0.1, 0.01, or 0.001 wt % oils and organic solvents or less. In some embodiments, the first aqueous composition is non-acidic, the second aqueous composition is non-acidic, or both the first and second composition are non-acidic. As used herein, non-acidic can refer to a composition having substantially no acid therein, for example, having a pH of about 7 or more, or of greater than about 6.8, 6.6, 6.4, 6.2, 6, 5.8, 5.7, 5.6, 5.5, 5.4, 5.3, 5.2, 5.1, or greater than about 5.

In various embodiments, the first aqueous composition and the second aqueous composition can each independently include at least one of water, brine, brackish water, flowback water, produced water, a lost circulation material, a drilling fluid, and a viscosifier. The first aqueous composition can include at least one of brine, a lost circulation material, a drilling fluid, and a viscosifier. The second aqueous composition can include at least one of water, brine, brackish water, flowback water, and produced water. In some embodiments, the first aqueous composition includes at least one of brine, a lost circulation material, a drilling fluid, and a viscosifier, while the second aqueous composition includes at least one of water, brine, brackish water, flowback water, and produced water.

In some embodiments, at least one of the first aqueous composition and the second aqueous composition includes brine, such as one or more brines. For example, the first aqueous composition can include brine. Brine can be useful to pump downhole for various applications. For example, the high density of certain brines can make them easier to pump deep downhole since the hydrostatic pressure helps to counterbalance the large amount of friction generated by the interaction of the fluid and passages downhole. Brine can help to maintain lubricity and viscosity of drilling fluid under extreme shear, pressure, and temperature variances. Completion brines can be used to displace drilling mud and can be an important step during well completion. Certain brines can be used as a solids-free drilling fluid with minimal cleanup upon completion. In some examples, brines can include water having dissolved therein one or more of sodium bromide (NaBr), calcium bromide ($CaBr_2$), zinc bromide ($ZnBr_2$), potassium bromide (KBr), sodium chloride (NaCl), calcium chloride ($CaCl_2$), zinc chloride ($ZnCl_2$), potassium chloride (KCl), sodium nitrate ($NaNO_3$), calcium nitrate ($Ca(NO_3)_2$), zinc nitrate ($Zn(NO_3)_2$), potassium nitrate ($KNO_3$), sea salt, formate brines including compounds such as potassium formate, cesium formate, sodium formate, or the like. The one or more salts can have any suitable concentration in the brine, such as about 0.001 wt % to about 80 wt %, or about 1 wt % to about 50 wt %, or about 0.001 wt % or less, or about 0.01 wt %, 0.1, 1, 2, 3, 4, 5, 10, 15, 20, 25, 30, 35, 40, 45, 50, 55, 60, 65, 70, 75, or about 80 wt % or more. The brine can have any suitable density. In some embodiments, the brine can have a density of about 8.345 lbs/gal to about 19.2 lbs/gal, alternatively about 9 lbs/gal to about 16 lbs/gal, alternatively about 10 lbs/gal to about 14.2 lbs/gal.

In some embodiments, at least one of the first and second aqueous compositions includes a lost circulation material, such as one or more lost circulation materials. For example, the first aqueous composition can include a lost circulation material. The lost circulation material can be any suitable lost circulation material. For example, the lost circulation material can be a solid material designed to accumulate over and block a flowpath in the formation through which material such as drilling material is being lost. Examples of lost circulation materials can include particles (e.g., ground or sized minerals such as limestone or marble, wood, nut hulls, Formica, corncobs, cotton hulls), flakes (e.g., mica flake, plastic flakes, cellophane sheeting flakes), or fibers (e.g., cedar bark, shredded cane stalks, mineral fiber, hair). In some embodiments, the lost circulation material can be a chemical sealant, designed to chemically seal off a flowpath. Chemical sealants can include any chemical sealant, such as at least one of a hydratable polymer, a crosslinkable polymer, a viscosifier, an aqueous rubber latex, a resin, a solid latex, a silicate-based material (e.g., sodium silicate), and an organophilic clay. Chemical sealants can include any material described as viscosifier herein. Organophilic clays can be clay minerals whose surfaces have been coated with a chemical to make them oil-dispersible. For example, bentonite or hectorite (plate-like clays), and attapulgite or sepiolite (rod-shaped clays) can be treated with oil-wetting agents such as tetraalkylammonium salts during manufacturing to form organophilic clays, with the amine applied to dry clay during grinding or applied to the clay dispersed in water.

In some embodiments, at least one of the first and second aqueous compositions includes a drilling fluid, such as one or more drilling fluids. For example, the first aqueous composition can include a drilling fluid. A drilling fluid, also known as a drilling mud or simply "mud," is a specially designed fluid for use in a wellbore as the wellbore is being drilled to facilitate the drilling operation. The drilling fluid can be water-based or oil-based. In some embodiments, the drilling fluid can carry cuttings up from beneath and around the bit, transport them up the annulus, and allow their separation. In some embodiments, the drilling fluid can carry cuttings away from the bit but the fluid is not recirculated. Also, a drilling fluid can cool and lubricate the drill head as well as reduce friction between the drill string and the sides of the hole. The drilling fluid aids in support of the drill pipe and drill head, and provides a hydrostatic head to maintain the integrity of the wellbore walls and prevent well blowouts. Specific drilling fluid systems can be selected to optimize a drilling operation in accordance with the characteristics of a particular geological formation. The drilling fluid can be formulated to prevent unwanted influxes of formation fluids from permeable rocks and also to form a thin, low permeability filter cake which temporarily seals pores, other openings, and formations penetrated by the bit. In water-based drilling fluids, solid particles are suspended in a water or brine solution containing other components. Oils or other non-aqueous liquids can be emulsified in the water or brine or at least partially solubilized (for less hydrophobic non-aqueous liquids), but water is the continuous phase. In various embodiments, the drilling fluid can include at least one of water (fresh or brine), a salt (e.g., calcium chloride, sodium chloride, potassium chloride, magnesium chloride, calcium bromide, sodium bromide, potassium bromide, calcium nitrate, sodium formate, potassium formate, cesium formate), aqueous base (e.g., sodium hydroxide or potassium hydroxide), alcohol or polyol, cellulose, starches, alkalinity control agents, density control agents such as a density modifier (e.g. barium sulfate), surfactants (e.g. betaines, alkali metal alkylene acetates, sultaines, ether carboxylates), emulsifiers, dispersants, polymeric stabilizers, crosslinking agents, polyacrylamides, polymers or combinations of polymers, antioxidants, heat stabilizers, foam control agents, solvents, diluents, plasticizers, filler or inorganic particles (e.g. silica, clays, minerals), pigments, dyes, precipitating agents (e.g., silicates or aluminum complexes), and rheology modifiers such as thickeners or viscosifiers (e.g., xanthan gum). Any ingredient listed in this paragraph can be either present or not present in the mixture, and can form any suitable amount of the aqueous composition, such as about 1 wt % or less, about 2 wt %, 3, 4, 5, 10, 15, 20, 30, 40, 50, 60, 70, 80, 85, 90, 95, 96, 97, 98, 99, 99.9, 99.99, 99.999, or about 99.9999 wt % or more of the aqueous composition.

In some embodiments, at least one of the first aqueous composition and the second aqueous composition includes a viscosifier, such as one or more viscosifiers. For example, the first aqueous composition can include a viscosifier. The viscosifier can be any suitable viscosifier. In some embodiments, the viscosifier can include at least one of a substituted or unsubstituted polysaccharide, and a substituted or unsubstituted polyalkenylene, wherein the polysaccharide or polyalkenylene is crosslinked or uncrosslinked. In some embodiments, the viscosifier can include a crosslinked gel or a crosslinkable gel. The viscosifier can affect the viscosity of the aqueous composition at any suitable time and location. In some embodiments, the viscosifier provides an increased viscosity at least one of before injection into the passage, at the time of injection into the passage, during travel through the passage downhole, once the aqueous composition exits the passage downhole, or some period of time after the aqueous composition exits the passage downhole. In some embodiments, the viscosifier can provide some or no increased viscosity until the viscosifier reaches a desired location downhole, at which point the viscosifier can provide a small or large increase in viscosity. In some embodiments, the viscosifier can be used to provide an enormous increase in viscosity downhole useful to seal a fracture or flowpath causing lost circulation; e.g., the viscosifier can act as a chemical sealant.

In some embodiments, the viscosifier includes at least one of a linear polysaccharide, and poly(($C_2$-$C_{10}$)alkenylene), wherein at each occurrence the ($C_2$-$C_{10}$)alkenylene is independently substituted or unsubstituted. In some embodiments, the viscosifier can include at least one of poly(acrylic acid) or ($C_1$-$C_5$)alkyl esters thereof, poly(methacrylic acid) or ($C_1$-$C_5$)alkyl esters thereof, poly(vinyl acetate), poly (vinyl alcohol), poly(ethylene glycol), poly(vinyl pyrrolidone), polyacrylamide, poly (hydroxyethyl methacrylate), acetan, alginate, chitosan, curdlan, a cyclosophoran, dextran, emulsan, a galactoglucopolysaccharide, gellan, glucuronan, N-acetyl-glucosamine, N-acetyl-heparosan, hyaluronic acid, indicant, kefiran, lentinan, levan, mauran, pullulan, scleroglucan, schizophyllan, stewartan, succinoglycan, xanthan, diutan, welan, starch, tamarind, tragacanth, guar gum, derivatized guar, gum ghatti, gum arabic, locust bean gum, cellulose, derivatized cellulose, carboxymethyl cellulose, hydroxyethyl cellulose, carboxymethyl hydroxyethyl cellulose, hydroxypropyl cellulose, methyl hydroxyl ethyl cellulose, guar, hydroxypropyl guar, carboxy methyl guar, and carboxymethyl hydroxylpropyl guar.

The first or second aqueous composition can include one or more crosslinkers including at least one of chromium, aluminum, antimony, zirconium, titanium, calcium, boron, iron, silicon, copper, zinc, magnesium, and an ion thereof. The first or second aqueous composition can include one or more crosslinkers including at least one of boric acid, borax, a borate, a ($C_1$-$C_{30}$)hydrocarbylboronic acid, a ($C_1$-$C_{30}$) hydrocarbyl ester of a ($C_1$-$C_{30}$)hydrocarbylboronic acid, a ($C_1$-$C_{30}$)hydrocarbylboronic acid-modified polyacrylamide, ferric chloride, disodium octaborate tetrahydrate, sodium metaborate, sodium diborate, sodium tetraborate, disodium tetraborate, a pentaborate, ulexite, colemanite, magnesium oxide, zirconium lactate, zirconium triethanol amine, zirconium lactate triethanolamine, zirconium carbonate, zirconium acetylacetonate, zirconium malate, zirconium citrate, zirconium diisopropylamine lactate, zirconium glycolate, zirconium triethanol amine glycolate, and zirconium lactate glycolate, titanium lactate, titanium malate, titanium citrate, titanium ammonium lactate, titanium triethanolamine, titanium acetylacetonate, aluminum lactate, or aluminum citrate.

In some embodiments, the viscosifier can include poly (vinyl alcohol) homopolymer, poly(vinyl alcohol) copolymer, a crosslinked poly(vinyl alcohol) homopolymer, and a crosslinked poly(vinyl alcohol) copolymer. The viscosifier can include a poly(vinyl alcohol) copolymer or a crosslinked poly(vinyl alcohol) copolymer including at least one of a graft, linear, branched, block, and random copolymer of vinyl alcohol and at least one of a substituted or unsubstituted ($C_2$-$C_{50}$)hydrocarbyl having at least one aliphatic unsaturated C—C bond therein, and a substituted or unsubstituted ($C_2$-$C_{50}$)alkene. The viscosifier can include a poly (vinyl alcohol) copolymer or a crosslinked poly(vinyl alcohol) copolymer including at least one of a graft, linear, branched, block, and random copolymer of vinyl alcohol and at least one of vinyl phosphonic acid, vinylidene diphosphonic acid, substituted or unsubstituted 2-acrylamido-2-methylpropanesulfonic acid, a substituted or unsubstituted ($C_1$-$C_{20}$)alkenoic acid, propenoic acid, butenoic acid, pentenoic acid, hexenoic acid, octenoic acid, nonenoic acid, decenoic acid, acrylic acid, methacrylic acid, hydroxypropyl acrylic acid, acrylamide, fumaric acid, methacrylic acid, hydroxypropyl acrylic acid, vinyl phosphonic acid, vinylidene diphosphonic acid, itaconic acid, crotonic acid, mesoconic acid, citraconic acid, styrene sulfonic acid, allyl sulfonic acid, methallyl sulfonic acid, vinyl sulfonic acid, and a substituted or unsubstituted ($C_1$-$C_{20}$)alkyl ester thereof. The viscosifier can include a poly(vinyl alcohol) copolymer or a crosslinked poly(vinyl alcohol) copolymer including at least one of a graft, linear, branched, block, and random copolymer of vinyl alcohol and at least one of vinyl acetate, vinyl propanoate, vinyl butanoate, vinyl pentanoate, vinyl hexanoate, vinyl 2-methyl butanoate, vinyl 3-ethylpentanoate, and vinyl 3-ethylhexanoate, maleic anhydride, a substituted or unsubstituted ($C_1$-$C_{20}$)alkenoic substituted or unsubstituted ($C_1$-$C_{20}$)alkanoic anhydride, a substituted or unsubstituted ($C_1$-$C_{20}$)alkenoic substituted or unsubstituted ($C_1$-$C_{20}$)alkenoic anhydride, propenoic acid anhydride, butenoic acid anhydride, pentenoic acid anhydride, hexenoic acid anhydride, octenoic acid anhydride, nonenoic acid anhydride, decenoic acid anhydride, acrylic acid anhydride, fumaric acid anhydride, methacrylic acid anhydride, hydroxypropyl acrylic acid anhydride, vinyl phosphonic acid anhydride, vinylidene diphosphonic acid anhydride, itaconic acid anhydride, crotonic acid anhydride, mesoconic acid anhydride, citraconic acid anhydride, styrene sulfonic acid anhydride, allyl sulfonic acid anhydride, methallyl sulfonic acid anhydride, vinyl sulfonic acid anhydride, and an N—($C_1$-$C_{10}$)alkenyl nitrogen containing substituted or unsubstituted ($C_1$-$C_{10}$)heterocycle. The viscosifier can include a poly(vinyl alcohol) copolymer or a crosslinked poly(vinyl alcohol) copolymer including at least one of a graft, linear, branched, block, and random copolymer that includes a poly(vinylalcohol)-poly(acrylamide) copolymer, a poly(vinylalcohol)-poly(2-acrylamido-2-methylpropanesulfonic acid) copolymer, or a poly(vinylalcohol)-poly(N-vinylpyrrolidone) copolymer. The viscosifier can include a crosslinked poly(vinyl alcohol) homopolymer or copolymer including a crosslinker including at least one of chromium, aluminum, antimony, zirconium, titanium, calcium, boron, iron, silicon, copper, zinc, magnesium, and an ion thereof. The viscosifier can include a crosslinked poly(vinyl alcohol) homopolymer or copolymer including a crosslinker including at least one of an aldehyde, an aldehyde-forming compound, a carboxylic acid or an ester thereof, a sulfonic acid or an ester thereof, a phosphonic acid or an ester thereof, an acid anhydride, and an epihalohydrin.

In some embodiments, at least one of the first aqueous composition and the second aqueous composition can include any suitable amount of any suitable material used in a downhole fluid. For example, the composition can include water, saline, aqueous base, acid, oil, organic solvent, synthetic fluid oil phase, aqueous solution, alcohol or polyol, cellulose, starch, alkalinity control agents, acidity control agents, density control agents, density modifiers, emulsifiers, dispersants, polymeric stabilizers, crosslinking agents, polyacrylamide, a polymer or combination of polymers, antioxidants, heat stabilizers, foam control agents, solvents, diluents, plasticizer, filler or inorganic particle, pigment, dye, precipitating agent, rheology modifier, oil-wetting agents, set retarding additives, surfactants, gases, weight reducing additives, heavy-weight additives, lost circulation materials, filtration control additives, salts, fibers, thixotropic additives, breakers, crosslinkers, rheology modifiers, curing accelerators, curing retarders, pH modifiers, chelating agents, scale inhibitors, enzymes, resins, water control materials, oxidizers, markers, Portland cement, pozzolana cement, gypsum cement, high alumina content cement, slag cement, silica cement, fly ash, metakaolin, shale, zeolite, a crystalline silica compound, amorphous silica, hydratable clays, microspheres, pozzolan lime, or a combination thereof. In various embodiments, the composition can include one or more additive components such as: thinner additives such as COLDTROL®, ATC®, OMC 2™, and OMC 42™; RHEMOD™, a viscosifier and suspension agent including a modified fatty acid; additives for providing temporary increased viscosity, such as for shipping (e.g., transport to the well site) and for use in sweeps (for example, additives having the tradename TEMPERUS™ (a modified fatty acid) and VIS-PLUS®, a thixotropic viscosifying polymer blend); TAU-MOD™, a viscosifying/suspension agent including an amorphous/fibrous material; additives for filtration control, for example, ADAPTA®, a HTHP filtration control agent including a crosslinked copolymer; DURATONE® HT, a filtration control agent that includes an organophilic lignite, more particularly organophilic leonardite; THERMO TONE™, a high temperature high pressure (HTHP) filtration control agent including a synthetic polymer; BDF™-366, a HTHP filtration control agent; BDF™-454, a HTHP filtration control agent; LIQUITONE™, a polymeric filtration agent and viscosifier; additives for HTHP emulsion stability, for example, FACTANT™, which includes highly concentrated tall oil derivative; emulsifiers such as LE SUPERMUL™ and EZ MUL® NT, polyaminated fatty acid emulsifiers, and FORTI-MUL®; DRIL TREAT®, an oil wetting agent for heavy fluids; BARACARB®, a sized ground marble bridging agent; BAROID®, a ground barium sulfate weighting agent; BAROLIFT®, a hole sweeping agent; SWEEP-WATE®, a sweep weighting agent; BDF-508, a diamine dimer rheology modifier; GELTONE® II organophilic clay; BAROFIBRE™ O for lost circulation management and seepage loss prevention, including a natural cellulose fiber; STEELSEAL®, a resilient graphitic carbon lost circulation material; HYDRO-PLUG®, a hydratable swelling lost circulation material; lime, which can provide alkalinity and can activate certain emulsifiers; and calcium chloride, which can provide salinity. Any suitable proportion of the first or second aqueous fluid can be any optional component listed in this paragraph, such as about 0.000.000.01 wt % to 99.999.99 wt %, 0.000.1-99.9 wt %, 0.1 wt % to 99.9 wt %, or about 20-90 wt %, or about 0.000.000.01 wt % or less, or about 0.000.001 wt %, 0.000.1, 0.001, 0.01, 0.1, 1, 2, 3, 4, 5, 10, 15, 20, 30, 40, 50, 60, 70, 80, 85, 90, 91, 92, 93, 94, 95, 96, 97, 98, 99, 99.9, 99.99, 99.999, 99.999.9, or about 99.999.99 wt % or more of the first or second aqueous composition.

In various embodiments, the present invention can include a proppant, a resin-coated proppant, an encapsulated resin, or a combination thereof. A proppant is a material that keeps an induced hydraulic fracture at least partially open during or after a fracturing treatment. Proppants can be transported downhole to the fracture using fluid, such as fracturing fluid or another fluid. A higher-viscosity fluid can more effectively transport proppants to a desired location in a fracture, especially larger proppants, by more effectively keeping proppants in a suspended state within the fluid. Examples of proppants can include sand, gravel, glass beads, polymer beads, ground products from shells and seeds such as walnut hulls, and manmade materials such as ceramic proppant. In some embodiments, proppant can have an average particle size, wherein particle size is the largest dimension of a particle, of about 0.001 mm to about 3 mm, about 0.15 mm to about 2.5 mm, about 0.25 mm to about 0.43 mm, about 0.43 mm to about 0.85 mm, about 0.85 mm to about 1.18 mm, about 1.18 mm to about 1.70 mm, or about 1.70 to about 2.36 mm. In some embodiments, the proppant can have a distribution of particle sizes clustering around multiple averages, such as one, two, three, or four different average particle sizes.

Concentration and Temperature.

In various embodiments, the first aqueous composition emerges from the tubular passage downhole and the second aqueous composition emerges from the annular passage downhole, forming a mixture downhole including the first aqueous composition and the second aqueous composition. In some embodiments, as compared to a corresponding method without the second aqueous composition, the second aqueous composition can at least one of cool and maintain a temperature of at least part of at least one of a mixture of the first and second aqueous composition downhole, a downhole assembly, a downhole location, a drill string region, and a jointed tubing string region. The second aqueous composition can dilute the first aqueous composition. The concentration of the first aqueous composition in the mixture can be any suitable concentration, such as about 0.001 wt % to about 99.999 wt %, about 1 wt % to about 99 wt %, or about 10 wt % to about 80 wt %, or about 0.001 wt % or less, 0.01 wt %, 1, 2, 3, 4, 5, 6, 8, 10, 15, 20, 25, 30, 35, 40, 45, 50, 55, 60, 65, 70, 75, 80, 85, 90, 92, 94, 96, 98, 99, 99.9, 99.99, or about 99.999 wt % or more. The concentration of the second aqueous composition in the mixture can be any suitable concentration, such as about 0.001 wt % to about 99.999 wt %, about 1 wt % to about 99 wt %, or about 10 wt % to about 80 wt %, or about 0.001 wt % or less, 0.01 wt %, 1, 2, 3, 4, 5, 6, 8, 10, 15, 20, 25, 30, 35, 40, 45, 50, 55, 60, 65, 70, 75, 80, 85, 90, 92, 94, 96, 98, 99, 99.9, 99.99, or about 99.999 wt % or more.

In some embodiments, the mixing, cooling (or maintenance of temperature), or both, can be controlled or varied by adjusting various parameters of the first aqueous composition, the second aqueous composition, or both, such as temperature, flow rate, and composition. For example, some embodiments include changing a flow rate of at least one of the first aqueous composition through the tubular passage and of the second aqueous composition through the annular passage. Some embodiments include changing a concentration of at least one of a component of the first aqueous composition and a component of the second aqueous composition. Some embodiments include changing a temperature of the first aqueous composition or the second aqueous composition.

In some embodiments, the method can include at least one of controlling a concentration of the first aqueous composition in the mixture and controlling a concentration of the second aqueous composition in the mixture. The method can include controlling a concentration of a component of the first aqueous composition in the mixture and controlling a concentration of a component of the second aqueous composition in the mixture. The concentration of the first aqueous composition in the mixture or a concentration of the second aqueous composition in the mixture can be varied by changing a flow rate of at least one of the first aqueous composition through the tubular passage and of the second aqueous composition through the annular passage. The concentration of a component of the first aqueous composition or the second aqueous composition in the mixture downhole can be varied by changing a composition or a flow rate of at least one of the first aqueous composition and the second aqueous composition. For example, by suitably varying a flow rate or a composition of one or both of the first and second aqueous compositions, a predetermined concentration of the first aqueous composition or a component thereof can be formed in the mixture downhole.

A downhole temperature in the wellbore can be any suitable temperature, such as a bottomhole static temperature, an elevated temperature generated by a drilling operation or other temperature-raising operation, a downhole temperature at any part of the subterranean formation, a temperature of a downhole location of the tubular passage, or the temperature of a subterranean flowpath fluidly connected to the wellbore. In some embodiments, the well can be a high temperature well or a well that includes high temperature conditions. In other embodiments, the method can be used with non-high temperature wells. The downhole temperature can be about 50° F. to about 600° F., about 100° F. to about 550° F., about 150° F. to about 500° F., about 200° F. to about 500° F., about 250° F. to about 500° F., about 300° F. to about 500° F., about 350° F. to about 500° F., or about 100° F. or less, or about 50° F. or less, or about 75° F., 100, 125, 150, 175, 200, 225, 250, 275, 300, 325, 350, 375, 400, 425, 450, 475, 500, 525, 550, 575° F., or about 600° F. or more. Some embodiments include approximately measuring a temperature downhole, such as an approximate temperature of at least one of the mixture, a downhole assembly, a downhole location, a drill string region, and a jointed tubing string region. In some embodiments, the method includes circulating the second aqueous composition through at least one of the tubular passage and the annular passage and allowing at least part of the second aqueous composition to flow back through at least one of the tubular passage and the annular passage, and at the surface, measuring a temperature of the flowed back second aqueous composition.

In some embodiments, the method includes lowering, or maintaining below an ambient downhole temperature, a temperature of at least part of at least one of the mixture, a downhole assembly, a downhole location, a drill string region, and a jointed tubing string region. For example, the injection of at least one of the first aqueous composition and the second aqueous composition can lower or maintains below an ambient downhole temperature (e.g., a bottomhole static temperature) a temperature of a downhole region or a material downhole. The downhole region or the material downhole can be at least part of at least one of the mixture, a downhole assembly, a downhole location, a drill string region, and a jointed tubing string region. For example, the temperature lowering or maintaining can be compared to a corresponding method performed without the second aqueous composition. In some embodiments, the lowering or maintaining below an ambient downhole temperature includes lowering or maintaining a downhole temperature (e.g., the temperature of the at least part of at least one of the mixture, the downhole assembly, the downhole location, the drill string region, and the jointed tubing string region) about 1° F. to about 450° F. below the ambient downhole temperature, about 10° F. to about 200° F. below the ambient downhole temperature, or about 1° F. or less below the ambient downhole temperature, or about 5° F., 10, 15, 20, 25, 30, 35, 40, 45, 50, 75, 100, 125, 150, 175, 200, 225, 250, 275, 300, 325, 350, 375, 400, 425° F., or about 450° F. below the ambient downhole temperature or more. The temperature of the first aqueous composition when it is injected into the tubular passage can be any suitable temperature, such as about −30° F. or less, −20, −10, 0, 10, 20, 30, 40, 50, 60, 70, 80, 90, 100, 120, 140, 160, 180, 200, 220, 240, 260, 280, 300° F. or more. The temperature of the second aqueous composition when it is injected into the annular passage can be any suitable temperature, such as about −30° F. or less, −20, −10, 0, 10, 20, 30, 40, 50, 60, 70, 80, 90, 100, 120, 140, 160, 180, 200, 220, 240, 260, 280, 300° F. or more.

The flow rate of the first aqueous composition through the tubular passage and the flow rate of the second aqueous composition through the annular passage can be any suitable flow rate. In some embodiments, a flow rate of the first aqueous composition through the tubular passage and a flow rate of the second aqueous composition through the annular passage can be substantially the same. In some embodiments, a flow rate of the first aqueous composition through the tubular passage and a flow rate of the second aqueous composition through the annular passage can be different. A mass ratio of a flow rate of the first aqueous composition though the tubular passage to a flow rate of the second aqueous composition through the annular passage can be about 1:100 to about 100:1, about 1:5 to about 5:1, about 1:100 or less, or about 1:90, 1:80, 1:70, 1:60, 1:50, 1:40, 1:30, 1:20, 1:10, 1:9, 1:8, 1:7, 1:6, 1:5, 1:4, 1:3, 1:2, 1:1, 2:1, 3:1, 4:1, 5:1, 6:1, 7:1, 8:1, 9:1, 10:1, 20:1, 30:1, 40:1, 50:1, 60:1, 70:1, 80:1, 90:1, or about 100:1 or more. The flow rates can be any suitable flow rates, such as 0.01 barrels per minute (BPM) to 300 BPM, or about 0.01 BPM or less, 0.1 BPM, 0.5, 1, 1.5, 2, 2.5, 3, 3.5, 4, 4.5, 5, 6, 7, 8, 9, 10, 15, 20, 25, 30, 35, 40, 45, 50, 75, 100, 150, 200, 250, or about 300 or more BPM.

In some embodiments, the method can include measuring a pressure, such as a pressure of the mixture (e.g., the bottomhole pressure, such as the weight of the fluid above the location where mixing of the first and second aqueous compositions occurs plus the compressive force applied to the first and second aqueous compositions), or a pressure of at least one of the first and second aqueous compositions in the tubular passage and in the annular passage, respectively. The method can include increasing an injection rate of at least one of the first aqueous composition and the second aqueous composition when the monitored pressure is below a threshold value.

In some embodiments, the method can include, prior to the placing of the first aqueous composition and the second aqueous composition in the subterranean formation, injecting an aqueous composition having any suitable composition in both the tubular passage and the annular passage. In some embodiments, the aqueous composition injected can have the same composition as the second aqueous composition.

In various embodiments, the first and second aqueous composition can be used, at least one of alone and in combination with other materials, as a drilling fluid, stimulation fluid, fracturing fluid, spotting fluid, clean-up fluid, completion fluid, remedial treatment fluid, abandonment fluid, pill, acidizing fluid, cementing fluid, packer fluid, or a combination thereof. For example, in some embodiments, the method can include fracturing at least part of the subterranean formation to form at least one subterranean fracture.

System or Apparatus.

In various embodiments, the present invention provides a system. The system can be any suitable system that can be used to perform an embodiment of the method of treating a subterranean formation described herein. For example, the system can include a tubular passage in a wellbore, the tubular passage including an injected first aqueous composition therein. The system can also include an annular passage in the wellbore, the annular passage including an injected second aqueous composition therein. The tubular passage and the annular passage can be configured to at least one of 1) allow the second aqueous composition to at least one of cool and maintain a temperature of at least part of at least one of a mixture of the first and second aqueous composition downhole, a downhole assembly, a downhole location, a drill string region, and a jointed tubing string region, and 2) form a mixture of the first aqueous composition and the second aqueous composition downhole. The system can include a pump configured to inject the first aqueous composition into the tubular passage. The system can include a pump configured to inject the second aqueous composition into the annular passage.

In various embodiments, the present invention provides an apparatus. The apparatus can be any suitable apparatus that can be used to perform an embodiment of the method of treating a subterranean formation described herein. For example, the apparatus can include a pump configured to inject a first aqueous composition into a tubular passage in a wellbore. The apparatus can include a pump configured to inject a second aqueous composition into an annular passage in the wellbore. The tubular passage and the annular passage can be configured to at least one of 1) allow the second aqueous composition to at least one of cool and maintain a temperature of at least part of at least one of a mixture of the first and second aqueous composition downhole, a downhole assembly, a downhole location, a drill string region, and a jointed tubing string region, and 2) form a mixture of the first aqueous composition and the second aqueous composition downhole.

The pump can be a high pressure pump in some embodiments. As used herein, the term "high pressure pump" will refer to a pump that is capable of delivering a fluid downhole at a pressure of about 1000 psi or greater. A high pressure pump can be used when it is desired to introduce the composition to a subterranean formation at or above a fracture gradient of the subterranean formation, but it can also be used in cases where fracturing is not desired. In some embodiments, the high pressure pump can be capable of fluidly conveying particulate matter, such as proppant particulates, into the subterranean formation. Suitable high pressure pumps will be known to one having ordinary skill in the art and can include, but are not limited to, floating piston pumps and positive displacement pumps.

In other embodiments, the pump can be a low pressure pump. As used herein, the term "low pressure pump" will refer to a pump that operates at a pressure of about 1000 psi or less. In some embodiments, a low pressure pump can be fluidly coupled to a high pressure pump that is fluidly coupled to the tubular passage or annular passage. That is, in such embodiments, the low pressure pump can be configured to convey the composition to the high pressure pump. In such embodiments, the low pressure pump can "step up" the pressure of the composition before it reaches the high pressure pump.

In some embodiments, the systems or apparatuses described herein can further include a mixing tank that is upstream of the pump and in which the first or second aqueous composition is formulated. In various embodiments, the pump (e.g., a low pressure pump, a high pressure pump, or a combination thereof) can convey the composition from the mixing tank or other source of the composition to the tubular passage or annular passage. In other embodiments, however, the composition can be formulated offsite and transported to a worksite, in which case the composition can be introduced to the tubular passage or annular passage via the pump directly from its shipping container (e.g., a truck, a railcar, a barge, or the like) or from a transport pipeline. In either case, the composition can be drawn into the pump, elevated to an appropriate pressure, and then introduced into the tubular passage or annular passage for delivery downhole.

FIG. 1 illustrates an embodiment of a system or apparatus 10 of the present invention. The system can include wellbore 26, drilled from the surface 14 into the subterranean formation. The wellbore 26 can be partially or substantially fully cased with casing 24. In various embodiments, the wellbore can include horizontal wells, slant wells, directional wells, high temperature wells, high pressure wells, high-temperature-high-pressure wells (HTHP), or combinations thereof. The system or apparatus can include tubular passage 2, in a drilling string or jointed tubing string 5. The system or apparatus can include annular passage 4 between tubular passage 2 and casing 24. The system or apparatus can include bottomhole assembly 6, such as a lower portion of a drill, coiled tubing, or completion assembly such as a bit, a bit sub, a mud motor, a stabilizer, a drill collar, a drill pipe, a jarring device, a crossover, a packer, a jetting nozzle, a screen, pre-perforated tubing, or combinations thereof. The system can include production zone 8 and fracture or flowpath 12.

Figure 2:
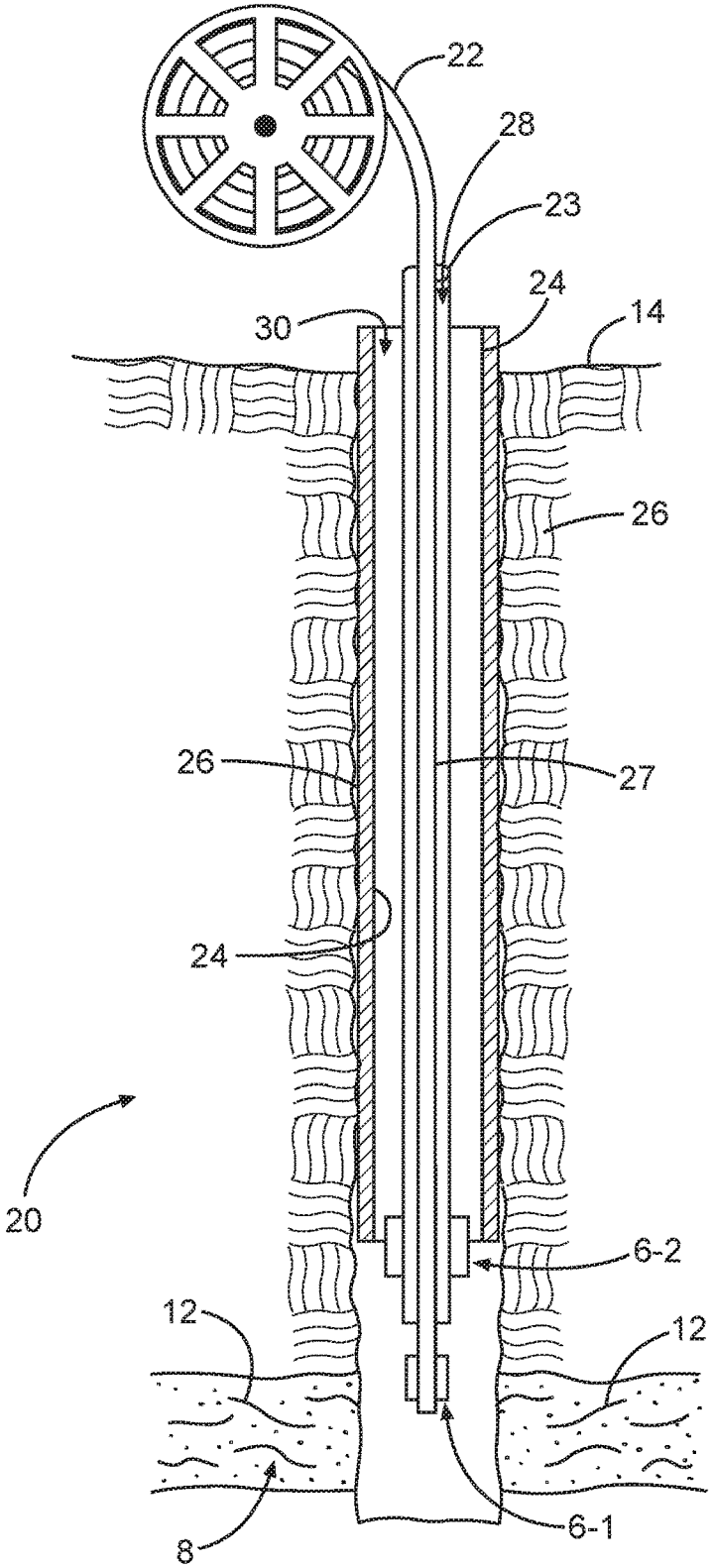
FIG. 2 illustrates a system or apparatus for treating a subterranean formation, in accordance with various embodiments.

FIG. 2 illustrates an embodiment of a system or apparatus 20 of the present invention. The system can include wellbore 26, drilled from surface 14 into the subterranean formation. The wellbore 26 can be partially or substantially cased with casing 24. The system or apparatus can include coiled tubing 22, having tubular passage 27 therein. The system or apparatus can include an annular passage, which can be one or both of the space 28 between the coiled tubing 22 and the jointed tubing 23 or the space 30 between the jointed tubing 23 and the casing 24. The coiled tubing 22 can have bottomhole assembly 6-1. The jointed tubing string 23 can have bottomhole assembly 6-2. The system can include production zone 8 and fracture or flowpath 12.

Figure 3:
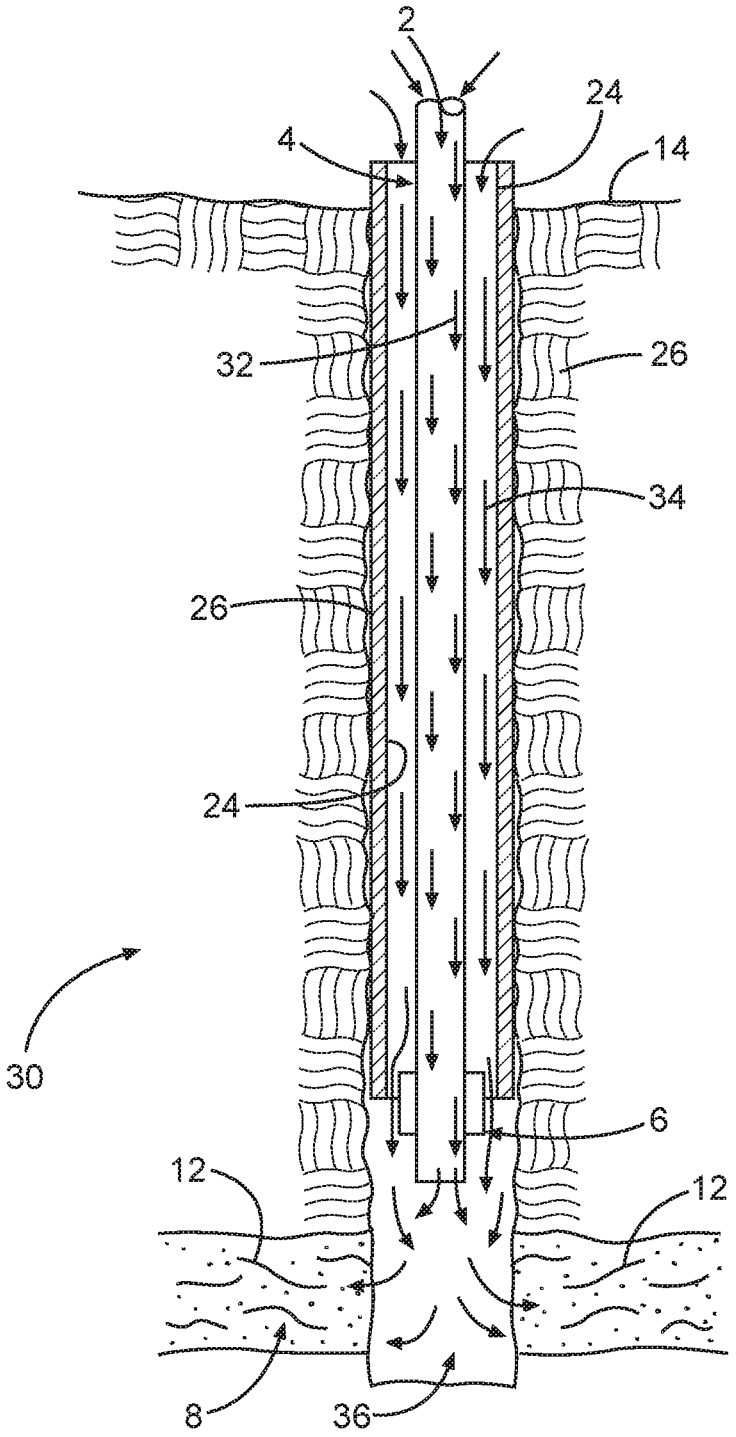
FIG. 3 illustrates a method of using a system or apparatus for treating a subterranean formation, in accordance with various embodiments.

FIG. 3 illustrates an embodiment of a method of using an embodiment of a system or apparatus 30 of the present invention. The system can include wellbore 26, drilled from surface 14 into the subterranean formation. The wellbore 26 can be partially or substantially cased with casing 24. The method can include injecting the first aqueous composition 32 into tubular passage 2, such as a drilling string or jointed tubing string. The method can include at least partially simultaneously injecting the second aqueous composition 34 into annular passage 4 between tubular passage 2 and casing 24. The first aqueous composition 32 emerges downhole from the tubular passage 2 and the second aqueous composition 34 emerges downhole from the annular passage 4, such that the first aqueous composition 32 and the second aqueous composition 34 combine to form mixture 36 downhole. The system or apparatus can include bottomhole assembly 6. The system can include production zone 8, and fracture or flowpath 12.

It is also to be recognized that embodiments of the method can directly or indirectly affect the various downhole equipment and tools, such as equipment and tools that come into contact with the first and second aqueous compositions during operation. Such equipment and tools can include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, and the like), logging tools and related telemetry equipment, actuators (e.g., electromechanical devices, hydromechanical devices, and the like), sliding sleeves, production sleeves, plugs, screens, filters, flow control devices (e.g., inflow control devices, autonomous inflow control devices, outflow control devices, and the like), couplings (e.g., electro-hydraulic wet connect, dry connect, inductive coupler, and the like), control lines (e.g., electrical, fiber optic, hydraulic, and the like), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components can be included in the systems and apparatuses generally described herein and depicted in FIGS. 1-3.

EXAMPLES

Various embodiments of the present invention can be better understood by reference to the following Examples which are offered by way of illustration. The present invention is not limited to the Examples given herein.

Example 1. Drilling Fluid in a High Temperature Well. (Hypothetical)

In a high temperature well having a bottomhole static temperature of about 400° F., an initial flow rate is established by pumping water through a drill string, recording the injection rate (4 barrels per minute (BPM)) and pressure. The injection rate through the drill string is reduced by half (2 BPM), and the remaining 2 BPM of water is pumped though the annulus. While pumping the water through the tubular passage and the annular passage, the water being pumped through the tubular passage is switched to a high viscosity drilling fluid. The drilling fluid maintains an acceptable viscosity downhole in the high temperature well due to the cooling effect of the water being pumped through the annulus.

Example 2. Lost Circulation Material in a High Temperature Well. (Hypothetical)

In a high temperature well having a bottomhole static temperature of about 400° F., an initial flow rate is established by pumping water through a drill string, recording the injection rate (4 BPM) and pressure. The injection rate through the drill string is reduced by half (2 BPM), and the remaining 2 BPM of water is pumped though the annulus. While pumping the water through the tubular passage and the annular passage, the water being pumped through the tubular passage is switched to a chemical sealant lost circulation material. The lost circulation material functions acceptably in the high temperature well due to the cooling effect of the water being pumped through the annulus.

Example 3. Brine Dilution. (Hypothetical)

In a well, an initial flow rate is established by pumping water through a drill string, recording the injection rate (4 BPM) and pressure. The injection rate through the drill string is reduced by half (2 BPM), and the remaining 2 BPM of water is pumped though the annulus. While pumping the water through the tubular passage and the annular passage, the water being pumped through the tubular passage is switched to a 20% brine. Five hundred oil barrels (bbls) of the 20% brine are pumped through the drill string, which mixes with water pumped down the annulus to generate 1000 bbls of 10% brine downhole.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present invention. Thus, it should be understood that although the present invention has been specifically disclosed by specific embodiments and optional features, modification and variation of the concepts herein disclosed may be resorted to by those of ordinary skill in the art, and that such modifications and variations are considered to be within the scope of embodiments of the present invention.

Additional Embodiments

The present invention provides for the following exemplary embodiments, the numbering of which is not to be construed as designating levels of importance:

Embodiment 1 provides a method of treating a subterranean formation, the method comprising: placing a first aqueous composition and a second aqueous composition in a subterranean formation, the placing comprising: injecting the first aqueous composition through a tubular passage in a wellbore; and at least partially simultaneously injecting the second aqueous composition through an annular passage in the wellbore.

Embodiment 2 provides the method of Embodiment 1, wherein the tubular passage comprises at least one of drill string tubing, a work string, and coiled tubing.

Embodiment 3 provides the method of any one of Embodiments 1-2, wherein the annular passage comprises a space between the wellbore and the tubular passage.

Embodiment 4 provides the method of any one of Embodiments 1-3, wherein the annular passage comprises at least one of a space between a drill string and a wellbore, a space between a drill string and a casing, a space between a coiled tubing and a wellbore, a space between a coiled tubing and a casing, a space between a coiled tubing and jointed tubing string, a space between a jointed tubing string and a casing, and a space between a jointed tubing string and a wellbore.

Embodiment 5 provides the method of any one of Embodiments 1-4, wherein the tubular passage comprises a drill string and the annular passage comprises a space at least one of between the drill string and a wellbore and between the drill string and casing.

Embodiment 6 provides the method of any one of Embodiments 1-5, wherein the tubular passage comprises coiled tubing and the annular passage comprises at least one of a space between the coiled tubing and a casing, a space between the coiled tubing and a wellbore, a space between a drill string and a casing, a space between the coiled tubing and a jointed tubing string, a space between a jointed tubing string and a wellbore, a space between a jointed tubing string and a casing, and a space between a drill string and a wellbore.

Embodiment 7 provides the method of any one of Embodiments 1-6, wherein the tubular passage comprises a jointed tubing string and the annular passage comprises at least one of a space between the jointed tubing string and a casing, and a space between the jointed tubing string and a wellbore.

Embodiment 8 provides the method of any one of Embodiments 1-7, wherein the first aqueous composition is non-acidic.

Embodiment 9 provides the method of any one of Embodiments 1-8, wherein the first aqueous composition and the second aqueous composition are non-acidic.

Embodiment 10 provides the method of any one of Embodiments 1-9, wherein the first aqueous composition and the second aqueous composition have substantially the same composition.

Embodiment 11 provides the method of any one of Embodiments 1-10, wherein the first aqueous composition and the second aqueous composition have different compositions.

Embodiment 12 provides the method of any one of Embodiments 1-11, wherein each of the first aqueous composition and the second aqueous composition independently comprise about 30 wt % to about 100 wt % water.

Embodiment 13 provides the method of any one of Embodiments 1-12, wherein each of the first aqueous composition and the second aqueous composition independently comprise greater than about 70 wt % water.

Embodiment 14 provides the method of any one of Embodiments 1-13, wherein each of the first aqueous composition and the second aqueous composition comprise less than about 30 wt % oil and organic solvents.

Embodiment 15 provides the method of any one of Embodiments 1-14, wherein the first aqueous composition comprises at least one of brine, a lost circulation material, a drilling fluid, and a viscosifier.

Embodiment 16 provides the method of any one of Embodiments 1-15, wherein the second aqueous composition comprises at least one of water, brine, brackish water, flowback water, and produced water.

Embodiment 17 provides the method of any one of Embodiments 1-16, wherein the first aqueous composition comprises at least one of brine, a lost circulation material, a drilling fluid, and a viscosifier, and the second aqueous composition comprises at least one of water, brine, brackish water, flowback water, and produced water.

Embodiment 18 provides the method of any one of Embodiments 1-17, wherein the first aqueous composition comprises a lost circulation material comprising at least one of particles, flakes, fibers, and chemical sealant.

Embodiment 19 provides the method of Embodiment 18, wherein the chemical sealant comprises at least one of hydratable polymer, a crosslinkable polymer, a viscosifier, an aqueous rubber latex, a solid latex, a resin, a silicate material, and an organophilic clay.

Embodiment 20 provides the method of any one of Embodiments 1-19, wherein the first aqueous composition comprises a drilling fluid comprising at least one of water, a salt, an aqueous base, an alcohol, a polyol, a cellulose, a starch, an alkalinity control agent, a density control agent, a surfactant, an emulsifier, a dispersant, a polymeric stabilizer, a crosslinking agent, a polyacrylamide, an antioxidant, a heat stabilizer, a foam control agent, a solvent, a diluent, a plasticizer, a filler, inorganic particles, a pigment, a dye, a precipitating agent, and a rheology modifier.

Embodiment 21 provides the method of any one of Embodiments 1-20, wherein the first aqueous composition comprises a viscosifier comprising at least one of a substituted or unsubstituted polysaccharide, and a substituted or unsubstituted polyalkenylene, wherein the polysaccharide or polyalkenylene is crosslinked or uncrosslinked.

Embodiment 22 provides the method of Embodiment 21, wherein the viscosifier comprises a crosslinked gel or a crosslinkable gel.

Embodiment 23 provides the method of any one of Embodiments 21-22, wherein the viscosifier comprises at least one of a linear polysaccharide, and poly(($C_2$-$C_{10}$)alkenylene), wherein the ($C_2$-$C_{10}$)alkenylene is substituted or unsubstituted.

Embodiment 24 provides the method of any one of Embodiments 21-23, wherein the viscosifier comprises at least one of poly(acrylic acid) or ($C_1$-$C_5$)alkyl esters thereof, poly(methacrylic acid) or ($C_1$-$C_5$)alkyl esters thereof, poly (vinyl acetate), poly(vinyl alcohol), poly(ethylene glycol), poly(vinyl pyrrolidone), polyacrylamide, poly (hydroxyethyl methacrylate), acetan, alginate, chitosan, curdlan, a cyclosophoran, dextran, emulsan, a galactoglucopolysaccharide, gellan, glucuronan, N-acetyl-glucosamine, N-acetyl-heparosan, hyaluronic acid, indicant, kefiran, lentinan, levan, mauran, pullulan, scleroglucan, schizophyllan, stewartan, succinoglycan, xanthan, diutan, welan, starch, tamarind, tragacanth, guar gum, derivatized guar, gum ghatti, gum arabic, locust bean gum, cellulose, derivatized cellulose, carboxymethyl cellulose, hydroxyethyl cellulose, carboxymethyl hydroxyethyl cellulose, hydroxypropyl cellulose, methyl hydroxyl ethyl cellulose, guar, hydroxypropyl guar, carboxy methyl guar, and carboxymethyl hydroxylpropyl guar.

Embodiment 25 provides the method of any one of Embodiments 21-24, wherein the first or second aqueous composition comprises a crosslinker comprising at least one of chromium, aluminum, antimony, zirconium, titanium, calcium, boron, iron, silicon, copper, zinc, magnesium, and an ion thereof.

Embodiment 26 provides the method of any one of Embodiments 21-25, wherein at least one of the first aqueous composition and the second aqueous composition comprises a crosslinker comprising at least one of boric acid, borax, a borate, a ($C_1$-$C_{30}$)hydrocarbylboronic acid, a ($C_1$-$C_{30}$)hydrocarbyl ester of a ($C_1$-$C_{30}$)hydrocarbylboronic acid, a ($C_1$-$C_{30}$)hydrocarbylboronic acid-modified polyacrylamide, ferric chloride, disodium octaborate tetrahydrate, sodium metaborate, sodium diborate, sodium tetraborate, disodium tetraborate, a pentaborate, ulexite, colemanite, magnesium oxide, zirconium lactate, zirconium triethanol amine, zirconium lactate triethanolamine, zirconium carbonate, zirconium acetylacetonate, zirconium malate, zirconium citrate, zirconium diisopropylamine lactate, zirconium glycolate, zirconium triethanol amine glycolate, and zirconium lactate glycolate, titanium lactate, titanium malate, titanium citrate, titanium ammonium lactate, titanium triethanolamine, titanium acetylacetonate, aluminum lactate, or aluminum citrate.

Embodiment 27 provides the method of any one of Embodiments 21-26, wherein the viscosifier comprises poly (vinyl alcohol) homopolymer, poly(vinyl alcohol) copolymer, a crosslinked poly(vinyl alcohol) homopolymer, and a crosslinked poly(vinyl alcohol) copolymer.

Embodiment 28 provides the method of any one of Embodiments 21-27, wherein the viscosifier comprises a poly(vinyl alcohol) copolymer or a crosslinked poly(vinyl alcohol) copolymer comprising at least one of a graft, linear, branched, block, and random copolymer of vinyl alcohol and at least one of a substituted or unsubstituted ($C_2$-$C_{50}$) hydrocarbyl having at least one aliphatic unsaturated C—C bond therein, and a substituted or unsubstituted ($C_2$-$C_{50}$) alkene.

Embodiment 29 provides the method of any one of Embodiments 21-28, wherein the viscosifier comprises a poly(vinyl alcohol) copolymer or a crosslinked poly(vinyl alcohol) copolymer comprising at least one of a graft, linear, branched, block, and random copolymer of vinyl alcohol and at least one of vinyl phosphonic acid, vinylidene diphosphonic acid, substituted or unsubstituted 2-acrylamido-2-methylpropanesulfonic acid, a substituted or unsubstituted ($C_1$-$C_{20}$)alkenoic acid, propenoic acid, butenoic acid, pentenoic acid, hexenoic acid, octenoic acid, nonenoic acid, decenoic acid, acrylic acid, methacrylic acid, hydroxypropyl acrylic acid, acrylamide, fumaric acid, methacrylic acid, hydroxypropyl acrylic acid, vinyl phosphonic acid, vinylidene diphosphonic acid, itaconic acid, crotonic acid, mesoconic acid, citraconic acid, styrene sulfonic acid, allyl sulfonic acid, methallyl sulfonic acid, vinyl sulfonic acid, and a substituted or unsubstituted ($C_1$-$C_{20}$)alkyl ester thereof.

Embodiment 30 provides the method of any one of Embodiments 21-29, wherein the viscosifier comprises a poly(vinyl alcohol) copolymer or a crosslinked poly(vinyl alcohol) copolymer comprising at least one of a graft, linear, branched, block, and random copolymer of vinyl alcohol and at least one of vinyl acetate, vinyl propanoate, vinyl butanoate, vinyl pentanoate, vinyl hexanoate, vinyl 2-methyl butanoate, vinyl 3-ethylpentanoate, and vinyl 3-ethylhexanoate, maleic anhydride, a substituted or unsubstituted ($C_1$-$C_{20}$)alkenoic substituted or unsubstituted ($C_1$-$C_{20}$)alkanoic anhydride, a substituted or unsubstituted ($C_1$-$C_{20}$) alkenoic substituted or unsubstituted ($C_1$-$C_{20}$)alkenoic anhydride, propenoic acid anhydride, butenoic acid anhydride, pentenoic acid anhydride, hexenoic acid anhydride, octenoic acid anhydride, nonenoic acid anhydride, decenoic acid anhydride, acrylic acid anhydride, fumaric acid anhydride, methacrylic acid anhydride, hydroxypropyl acrylic acid anhydride, vinyl phosphonic acid anhydride, vinylidene diphosphonic acid anhydride, itaconic acid anhydride, crotonic acid anhydride, mesoconic acid anhydride, citraconic acid anhydride, styrene sulfonic acid anhydride, allyl sulfonic acid anhydride, methallyl sulfonic acid anhydride, vinyl sulfonic acid anhydride, and an N—($C_1$-$C_{10}$)alkenyl nitrogen containing substituted or unsubstituted ($C_1$-$C_{10}$)heterocycle.

Embodiment 31 provides the method of any one of Embodiments 21-30, wherein the viscosifier comprises a poly(vinyl alcohol) copolymer or a crosslinked poly(vinyl alcohol) copolymer comprising at least one of a graft, linear, branched, block, and random copolymer that comprises a poly(vinylalcohol)-poly(acrylamide) copolymer, a poly(vinylalcohol)-poly(2-acrylamido-2-methylpropanesulfonic acid) copolymer, or a poly(vinylalcohol)-poly(N-vinylpyrrolidone) copolymer.

Embodiment 32 provides the method of any one of Embodiments 21-31, wherein the viscosifier comprises a crosslinked poly(vinyl alcohol) homopolymer or copolymer comprising a crosslinker comprising at least one of chromium, aluminum, antimony, zirconium, titanium, calcium, boron, iron, silicon, copper, zinc, magnesium, and an ion thereof.

Embodiment 33 provides the method of any one of Embodiments 21-32, wherein the viscosifier comprises a crosslinked poly(vinyl alcohol) homopolymer or copolymer comprising a crosslinker comprising at least one of an aldehyde, an aldehyde-forming compound, a carboxylic acid or an ester thereof, a sulfonic acid or an ester thereof, a phosphonic acid or an ester thereof, an acid anhydride, and an epihalohydrin.

Embodiment 34 provides the method of any one of Embodiments 1-33, wherein the first aqueous composition and the second aqueous composition each independently comprise at least one of water, brine, brackish water, flowback water, produced water, a lost circulation material, a drilling fluid, and a viscosifier.

Embodiment 35 provides the method of any one of Embodiments 1-34, wherein the first aqueous composition and the second aqueous composition each independently comprise at least one of a drilling fluid, stimulation fluid, clean-up fluid, spotting fluid, completion fluid, remedial treatment fluid, fracturing fluid, pill, water, saline, aqueous base, acid, oil, organic solvent, diesel, synthetic fluid oil phase, aqueous solution, alcohol or polyol, cellulose, starch, alkalinity control agent, acidity control agent, density control agent, density modifier, emulsifier, dispersant, polymeric stabilizer, crosslinking agent, polyacrylamide, polymer or combination of polymers, antioxidant, heat stabilizer, foam control agent, foaming agent, solvent, diluent, plasticizer, filler or inorganic particle, pigment, dye, precipitating agent, rheology modifier, oil-wetting agent, set retarding additive, surfactant, gas, weight reducing additive, heavyweight additive, lost circulation material, filtration control additive, salt, fiber, thixotropic additive, breaker, crosslinker, gas, rheology modifier, curing accelerator, curing retarder, pH modifier, chelating agent, scale inhibitor, enzyme, resin, water control material, polymer, oxidizer, a marker, fly ash, metakaolin, shale, zeolite, a crystalline silica compound, amorphous silica, fibers, a hydratable clay, microspheres, and pozzolan lime.

Embodiment 36 provides the method of any one of Embodiments 1-35, wherein the injecting of the first aqueous composition through the tubular passage and the injecting of the second aqueous composition through the annular passage is substantially simultaneous.

Embodiment 37 provides the method of any one of Embodiments 1-36, further comprising changing a flow rate of at least one of the first aqueous composition through the tubular passage and of the second aqueous composition through the annular passage.

Embodiment 38 provides the method of any one of Embodiments 1-37, further comprising changing a concentration of at least one of a component of the first aqueous composition and a component of the second aqueous composition.

Embodiment 39 provides the method of any one of Embodiments 1-38, further comprising changing a temperature of at least one of a component of the first aqueous composition and a component of the second aqueous composition.

Embodiment 40 provides the method of any one of Embodiments 1-39, wherein the first aqueous composition emerges from the tubular passage downhole and the second aqueous composition emerges from the annular passage downhole, forming a mixture downhole comprising the first aqueous composition and the second aqueous composition.

Embodiment 41 provides the method of Embodiment 40, further comprising at least one of controlling a concentration of the first aqueous composition in the mixture and controlling a concentration of the second aqueous composition in the mixture.

Embodiment 42 provides the method of any one of Embodiments 40-41, further comprising controlling a concentration of a component of the first aqueous composition in the mixture and controlling a concentration of a component of the second aqueous composition in the mixture.

Embodiment 43 provides the method of any one of Embodiments 40-42, wherein a concentration of the first aqueous composition in the mixture or a concentration of the second aqueous composition in the mixture is varied by changing a flow rate of at least one of the first aqueous composition through the tubular passage and of the second aqueous composition through the annular passage.

Embodiment 44 provides the method of any one of Embodiments 40-43, wherein a concentration of a component of the first aqueous composition in the mixture or a concentration of a component of the second aqueous composition in the mixture is varied by changing at least one of a flow rate of at least one of the first aqueous composition through the tubular passage and the second aqueous composition through the annular passage, and a concentration of at least one of the component of the first aqueous composition and the component of the second aqueous composition.

Embodiment 45 provides the method of any one of Embodiments 40-44, wherein the second aqueous composition dilutes the first aqueous composition in the mixture.

Embodiment 46 provides the method of any one of Embodiments 40-45, wherein a concentration of the first aqueous composition in the mixture about 0.001 wt % to about 99.999 wt %.

Embodiment 47 provides the method of any one of Embodiments 40-46, wherein a concentration of the second aqueous composition in the mixture about 0.001 wt % to about 99.999 wt %.

Embodiment 48 provides the method of any one of Embodiments 40-47, wherein a downhole temperature of the subterranean formation comprises about 200° F. to about 500° F.

Embodiment 49 provides the method of any one of Embodiments 40-48, further comprising lowering or maintaining below an ambient downhole temperature a temperature of at least part of at least one of the mixture, a downhole assembly, a downhole location, a drill string region, and a jointed tubing string region.

Embodiment 50 provides the method of any one of Embodiments 40-49, wherein the injection of at least one of the first aqueous composition and the second aqueous composition at least one of lowers and maintains below an ambient downhole temperature a temperature of at least part of at least one of the mixture, a downhole assembly, a downhole location, a drill string region, and a jointed tubing string region.

Embodiment 51 provides the method of Embodiment 50, wherein the lowering or maintaining below an ambient downhole temperature comprises lowering or maintaining the temperature about 1° F. to about 450° F. below the ambient downhole temperature.

Embodiment 52 provides the method of any one of Embodiments 50-51, wherein the lowering or the maintaining below an ambient downhole temperature comprises lowering or maintaining about 10° F. to about 200° F. below the ambient downhole temperature.

Embodiment 53 provides the method of any one of Embodiments 50-52, wherein the lowering or the maintaining below an ambient downhole temperature comprises lowering or maintaining below an ambient downhole temperature a temperature of at least part of at least one of the mixture, downhole assembly, downhole location, drill string region, and jointed tubing string region using the second aqueous fluid.

Embodiment 54 provides the method of any one of Embodiments 1-53, wherein a flow rate of the first aqueous composition through the tubular passage and a flow rate of the second aqueous composition through the annular passage are substantially the same.

Embodiment 55 provides the method of any one of Embodiments 1-54, wherein a flow rate of the first aqueous composition through the tubular passage and a flow rate of the second aqueous composition through the annular passage are different.

Embodiment 56 provides the method of any one of Embodiments 1-55, wherein a mass ratio of a flow rate of the first aqueous composition though the tubular passage to a flow rate of the second aqueous composition through the annular passage is about 1:100 to about 100:1.

Embodiment 57 provides the method of any one of Embodiments 1-56, wherein a mass ratio of a flow rate of the first aqueous composition though the tubular passage to a flow rate of the second aqueous composition through the annular passage is about 1:5 to about 5:1.

Embodiment 58 provides the method of any one of Embodiments 1-57, further comprising measuring a temperature downhole.

Embodiment 59 provides the method of any one of Embodiments 40-58, further comprising measuring a temperature of at least one of the mixture, a downhole assembly, a downhole location, a drill string region, and a jointed tubing string region.

Embodiment 60 provides the method of any one of Embodiments 1-59, further comprising: circulating the second aqueous composition through at least one of the tubular passage and the annular passage and allowing at least part of the second aqueous composition to flow back through at least one of the tubular passage and the annular passage; and at the surface, measuring a temperature of the flowed back second aqueous composition.

Embodiment 61 provides the method of any one of Embodiments 40-60, further comprising measuring a pressure of the mixture.

Embodiment 62 provides the method of Embodiment 61, further comprising increasing an injection rate of at least one of the first aqueous composition and the second aqueous composition when the monitored pressure is below a threshold value.

Embodiment 63 provides the method of any one of Embodiments 1-62, further comprising, prior to the placing of the first aqueous composition and the second aqueous composition, injecting an aqueous composition in both the tubular passage and the annular passage.

Embodiment 64 provides the method of any one of Embodiments 1-63, further comprising, prior to the placing of the first aqueous composition and the second aqueous composition, injecting the second aqueous composition in both the tubular passage and the annular passage.

Embodiment 65 provides the method of any one of Embodiments 1-64, further comprising fracturing at least part of the subterranean formation to form at least one subterranean fracture.

Embodiment 66 provides the method of any one of Embodiments 1-65, wherein the first or second aqueous composition further comprises a proppant, a resin-coated proppant, or a combination thereof.

Embodiment 67 provides a method of treating a subterranean formation, the method comprising: placing a first aqueous composition and a second aqueous composition in a subterranean formation, the placing comprising: injecting the first aqueous composition through a tubular passage in a wellbore, the first aqueous composition comprising less than about 30 wt % oil and organic solvents and comprises at least one of brine, a lost circulation material, a drilling fluid, and a viscosifier; and at least partially simultaneously injecting the second aqueous composition through an annular passage in the wellbore, the second aqueous composition comprising less than about 30 wt % oil and organic solvents and comprising at least one of water, brine, brackish water, flowback water, and produced water; wherein the first aqueous composition emerges from the tubular passage downhole and the second aqueous composition emerges from the annular passage downhole, forming a mixture downhole comprising the first aqueous composition and the second aqueous composition.

Embodiment 68 provides the method of Embodiment 67, comprising changing a concentration in the mixture of at least one of the first aqueous composition, the second aqueous composition, a component of the first aqueous composition, and a component of the second aqueous composition by changing at least one of a flow rate of at least one of the first aqueous composition through the tubular passage and the second aqueous composition through the annular passage, and a concentration of at least one of the component of the first aqueous composition and the component of the second aqueous composition.

Embodiment 69 provides a method of treating a subterranean formation, the method comprising: placing a first aqueous composition and a second aqueous composition in a subterranean formation, the placing comprising: injecting the first aqueous composition through a tubular passage in a wellbore, the first aqueous composition comprising less than about 30 wt % oil and organic solvents and comprises at least one of brine, a lost circulation material, a drilling fluid, and a viscosifier; and at least partially simultaneously injecting the second aqueous composition through an annular passage in the wellbore, the second aqueous composition comprising less than about 30 wt % oil and organic solvents and comprising at least one of water, brine, brackish water, flowback water, and produced water; wherein the injection of at least one of the first aqueous composition and the second aqueous composition lowers or maintains below an ambient downhole temperature a temperature of at least part of at least one of the mixture, a downhole assembly, a downhole location, a drill string region, and a jointed tubing string region.

Embodiment 70 provides an apparatus comprising: a pump configured to inject a first aqueous composition into a tubular passage in a wellbore; and a pump configured to inject a second aqueous composition into an annular passage in the wellbore; wherein the tubular passage and the annular passage are configured to at least one of: allow the second aqueous composition to at least one of cool and maintain a temperature of at least part of at least one of a mixture of the first and second aqueous composition downhole, a downhole assembly, a downhole location, a drill string region, and a jointed tubing string region, and form a mixture of the first aqueous composition and the second aqueous composition downhole.

Embodiment 71 provides a system comprising: a tubular passage in a wellbore comprising an injected first aqueous composition therein; an annular passage in the wellbore comprising an injected second aqueous composition therein; wherein the tubular passage and the annular passage are configured to at least one of: 1) allow the second aqueous composition to at least one of cool and maintain a temperature of at least part of at least one of a mixture of the first and second aqueous composition downhole, a downhole assembly, a downhole location, a drill string region, and a jointed tubing string region, and 2) form a mixture of the first aqueous composition and the second aqueous composition downhole.

Embodiment 72 provides the system of Embodiment 71, further comprising a pump configured to inject the first aqueous composition into the tubular passage.

Embodiment 73 provides the system of any one of Embodiments 71-72, further comprising a pump configured to inject the second aqueous composition into the annular passage.

Embodiment 74 provides the apparatus, method, or system of any one or any combination of Embodiments 1-73 optionally configured such that all elements or options recited are available to use or select from.

What is claimed is:

1. A method for treating a subterranean formation, the method comprising:

selecting a temperature, wherein the temperature is about 10° F. to about 200° F. below an ambient downhole temperature, wherein the ambient downhole temperature is about 400° F. or higher;

calculating a first flow rate, composition, temperature, or combinations thereof of a drilling fluid;

calculating a second flow rate, composition, temperature, or combinations thereof of a second aqueous composition, wherein the drilling fluid and second aqueous composition have different compositions, such that a downhole temperature of a mixture comprising the drilling fluid and the second aqueous composition is at or below the selected temperature;

injecting an aqueous composition for cooling through both a drill string tubing and an annular passage defined by a space between the drill string tubing and the wellbore;

placing the drilling fluid and the second aqueous composition in a subterranean formation after the step of injecting the aqueous composition for cooling, the placing comprising:

simultaneously injecting the drilling fluid through the drill string tubing and the second aqueous composition through the annular passage;

wherein the drilling fluid emerges from the drill string tubing and the second aqueous composition emerges from the annular passage downhole, forming the mixture downhole comprising the drilling fluid and the second aqueous composition; and wherein the drill string tubing and the annular passage are adjacent to each other such that the drilling fluid and the second aqueous composition are in thermal communication as each composition is injected through their respective passage.

2. The method of claim 1, wherein a flow rate of the drilling fluid through the drill string tubing and a flow rate of the second aqueous composition through the annular passage are substantially the same.

3. The method of claim 1, wherein a mass ratio of a flow rate of the drilling fluid through the tubular passage to a flow rate of the second aqueous composition through the annular passage is about 1:100 to about 100:1.

4. The method of claim 1, further comprising measuring a temperature of the mixture downhole.

5. The method of claim 1, further comprising:

circulating the second aqueous composition through at least one of the tubular passage and the annular passage and allowing at least part of the second aqueous composition to flow back through at least one of the tubular passage and the annular passage; and at the surface, measuring a temperature of the flowed back second aqueous composition.

* * * * *